US005926161A

United States Patent [19]

Furuhashi et al.

[11] Patent Number: 5,926,161

[45] Date of Patent: Jul. 20, 1999

[54] LIQUID CRYSTAL PANEL AND LIQUID CRYSTAL DISPLAY DEVICE

[75] Inventors: Tsutomu Furuhashi, Yokohama; Hiroyuki Mano, Chigasaki; Makiko Ikeda, Yokohama; Toshio Futami; Masayuki Ohta, both of Mobara; Katsumi Kondo, Hitachinaka, all of Japan

[73] Assignee: Hitachi, Ltd., Tokyo, Japan

[21] Appl. No.: 08/595,254

[22] Filed: Feb. 1, 1996

[30] Foreign Application Priority Data

Feb. 1, 1995 [JP] Japan ..... 7-015213

[51] Int. Cl.[6] ..... G09G 3/36

[52] U.S. Cl. ..... 345/100

[58] Field of Search ..... 345/100, 94, 95, 345/98

[56] References Cited

U.S. PATENT DOCUMENTS

| | | | |
|---|---|---|---|
| 4,842,371 | 6/1989 | Yasuda et al. | 350/333 |
| 4,984,873 | 1/1991 | Takiguchi et al. | 350/337 |
| 5,249,070 | 9/1993 | Takano | 359/54 |
| 5,414,443 | 5/1995 | Kanatani et al. | 345/95 |
| 5,657,039 | 8/1997 | Mizukata et al. | 345/95 |
| 5,666,133 | 9/1997 | Matsuo et al. | 345/95 |
| 5,719,647 | 2/1998 | Fujikawa et al. | 349/40 |
| 5,745,200 | 4/1998 | Kikuchi et al. | 349/99 |
| 5,748,275 | 5/1998 | Sato et al. | 349/144 |

FOREIGN PATENT DOCUMENTS 2-10955 3/1990 Japan .

*Primary Examiner*—Mark K. Zimmerman
*Assistant Examiner*—Ronald Laneau
*Attorney, Agent, or Firm*—Antonelli, Terry, Stout & Kraus, LLP

[57] ABSTRACT

A liquid crystal panel and a liquid crystal display device including the panel which has a transparent first substrate, a second substrate arranged so as to oppose the first substrate with a space therebetween and liquid crystals filled in the space between the first substrate and the second substrate and having a twist angle which changes in a plane in parallel with a direction of an electric field. The panel has pixels including pixel electrodes connected to source electrodes and counter electrodes with the pixels being arranged in M rows and N columns, where M and N are integers of at least two. Both of the pixel electrodes and the counter electrodes are provided at the second substrate. The panel also includes drain lines independently provided for respective columns, gate lines independently provided for respective rows, and counter lines connected to the counter electrodes. The counter lines include first counter lines at at least one of odd number columns and odd number rows and second counter lines at at least one of even number columns and even number rows with the first and second counter lines being independent of one another.

26 Claims, 15 Drawing Sheets

LIQUID CRYSTAL PANEL AND LIQUID CRYSTAL DISPLAY DEVICE

The present invention relates to a TFT (Thin Film Transistor) liquid crystal display, and more particularly to the structure and drive circuit for a TFT liquid crystal panel for display with high image quality and for operation with low power consumption.

BACKGROUND OF THE INVENTION

A drive substrate having TFTs and pixel electrodes on one glass substrate and a counter substrate having a common electrode and a color filter on another glass substrate are provided in a conventional TFT liquid crystal display. Further, the TFT liquid crystal panel is constituted by providing liquid crystals between these two sheets of glass substrates. The structure of the TFT is described, for example, in Japanese Examined Patent Publication No. 10955/1990.

As shown in FIG. 21, a conventional TFT liquid crystal display device includes a liquid crystal controller 201, signal drive circuits 206 and 207, a scan drive circuit 210, a power source circuit 212 and a liquid crystal panel 218. The TFT liquid crystal panel 218 has N drain buses 208 and 209 and M gate buses 211 in a matrix form. Further, pixels 219 are formed at respective intersection points. The TFT liquid crystal panel 218 has an N×M arrangement of the pixels 219. Each pixel 219 includes a TFT 220, a liquid crystal (capacitor) 221, an auxiliary capacitor 222, a counter electrode 223 and an auxiliary capacitor electrode 224. In FIG. 21 the liquid crystals are equivalently represented as capacitors 221. The auxiliary capacitor 222 is provided for reducing leakage current from the liquid crystal 221. In the TFT liquid crystal panel 218, an orientation state of the liquid crystal molecules is maintained by storing an electric charge in the capacitors 221 and the auxiliary capacitors 222. The TFT 220 operates as a switch for controlling charge/discharge of the electric charge to and from the capacitors 221 and 222.

The liquid crystal controller 201 controls the signal drive circuits 206 and 207 and the scan drive circuit 210 based on display data and synchronizing signals supplied from a system (not shown) via a signal bus 101. The liquid crystal controller 201 supplies the signal drive circuits 206 and 207 with liquid crystal display data and liquid crystal drive signals via signal buses 202 and 203. Further, the controller supplies various signals to the scan drive circuit 210 via a signal bus 204 and to a power source circuit 212 via a signal bus 205.

The signal drive circuits 206 and 207 supply the liquid crystal panel 218 with a drain voltage (Vd) corresponding to the liquid crystal display data via drain buses 208 and 209. A suitable circuit for the signal drive circuits 206 and 207 is disclosed in "TFT driver for VDT: HD66310 T" described in "Hitachi LCD controller/driver LSI data book (Hitachi, Ltd., semiconductor division, 1994) on pp. 933–947. In FIG. 21, a plurality of the liquid crystal controllers are used. The scan drive circuit 210 supplies the liquid crystal panel 218 with gate voltages (Vg) successively selecting the pixels of one horizontal line via a gate bus 211.

The power source circuit 212 supplies the different voltages necessary for driving the liquid crystal panel 218 to the above-described portions. The power source circuit 212 supplies power source voltages to the scan drive circuit 210 via a power source bus 213 and to the respective signal drive circuits 206 and 207 via power source buses 214 and 215.

Further,the power source circuit 212 supplies counter electrode voltages (Vcom) to counter electrodes 223 via a power source bus 216 and auxiliary capacitor voltages (Vstg) to auxiliary capacitor electrodes 224 via a power source bus 217.

A specific structure of the pixel 219 of FIG. 21 is described with reference to FIG. 22 and FIG. 23. As shown in FIG. 22 the liquid crystal panel 218 is constituted by glass substrates 401 and 402, polarizing films 403 and 404, orientation films 405 and 406, an insulating film 407 and liquid crystal molecules 408. Further, the liquid crystal panel includes the TFTs 220 and the counter electrodes 223. The liquid crystal molecules 408 have a twist structure as shown in FIG. 22 by the orientation control of the orientation films 405 and 406. The insulating film 407 disposed between the pixel electrode 303 and the auxiliary capacitor electrodes 224 operates as the above-described auxiliary capacitor 222. The TFT 220 is provided on the glass substrate 402 and the counter electrode 223 is provided on the glass substrate 401.

As shown in FIG. 23, the TFT 220 includes a silicon portion 301, a source electrode 302, a pixel electrode 303, a gate electrode and a drain electrode. The gate electrode is constituted by a gate line Gm of the gate bus 211 and the drain electrode is constituted by a drain line Dn of the drain bus 208.

FIG. 24 illustrates a voltage/brightness characteristic of a liquid crystal. The abscissa designates a voltage value applied on the liquid crystal and the ordinate designates a brightness. In FIG. 24 the following notations are utilized.

Vcen: Reference voltage value (equivalent to counter electrode voltage Vcom in FIGS. 25(*a*) and 25(*b*));

VdB1: Voltage level performing negative black display;

VdW1: Voltage level performing negative white display;

VdW2: Voltage level performing positive white display; and

VdB2: Voltage level performing positive black display.

FIGS. 25(*a*) and 25(*b*) illustrate drive voltage waveforms of a liquid crystal panel in a case where the reference voltage (Vcen) is regarded as the counter electrode voltage (Vcom) and the auxiliary capacitor electrode voltage(Vstg).

The following notations are utilized in FIGS. 25(*a*) and 25(*b*).

Vg (m): Voltage waveform of gate line GM;

Vd (n): Voltage waveform of drain line Dn;

Vd (n+1): Voltage waveform of drain line Dn+1;

Vs(m)(n): Waveform of pixel electrode voltage (hereinafter, "source voltage") applied on the pixel 219 at the m-th row and n-th column; and Vs(m)(n+1): Waveform of source voltage applied on the pixel 219 at the m-th row and (n+1)-th column.

In operation of the conventional liquid crystal display device, the liquid crystal controller 201 converts display data and synchronizing signals transmitted through the signal bus 201 into liquid crystal display data and liquid crystal drive signals for driving the TFT liquid crystal panel 218. Further, the liquid crystal drive signals after conversion are supplied to the signal drive circuits 206 and 207 via the respective signal buses 202 and 203 and are further supplied to the scan drive circuit 210 via the signal bus 204. Additionally, predetermined signals are supplied to the power source circuit 212 via the signal bus 205.

The signal drive circuits 206 and 207 successively receive the liquid crystal display data sent via the signal buses 202 and 203 and form drain voltages corresponding to the liquid crystal display data. At this occasion, when the liquid crystal display data of one horizontal line have been received, the signal drive circuits 206 and 207 simultaneously output the drain voltages corresponding to the liquid crystal display data of the one horizontal line to the drain buses 208 and 209 in synchronism with the synchronizing signals sent in a similar manner. The signal drive circuits 206 and 207 continue outputting the drain voltages during the one horizontal period. In parallel with outputting of the drain voltages, the signal drive circuits 206 and 207 successively receive the liquid crystal display data of a next line. By repeating this operation during one frame period, the signal drive circuits 206 and 207 form the drain voltages corresponding to the liquid crystal display data of the one frame.

In the liquid crystal panel 218, a twist angle of the liquid crystal molecules 408 present in the pixel portion, that is, the transmittance of the pixel is changed by controlling the electric field with regard to each pixel. The electric field control is performed by controlling a voltage difference (potential difference) between the drain voltage (Vd) applied on the pixel electrode 303 and the voltage (Vcom) applied on the counter electrode 223. As shown in FIG. 24, when the reference voltage (Vcen) is considered as a reference, the transmittance is lowered and the pixel becomes dark when the applied voltage difference is large. However, the transmittance is promoted and the pixel becomes bright when the applied voltage difference is small.

The application of the drain voltage Vd on the pixel electrode 303 is effected by successively applying a select voltage on the gate bus 211 by the scan drive circuit 210 in synchronism with outputting the drain voltage Vd to the drain buses 208 and 209 by the signal drive circuits 206 and 207. When an ON voltage (vgon) is applied on the gate line Gm, the drain voltages (Vd (n),Vd (n+1)) supplied to the drain lines Dn, D(n+1) are applied on the pixel electrode 303 at the m-th column via the TFT 220. As a result the drain voltages (Vd(n), Vd(n+1)) applied at this time become th source voltages (Vs(m) (n), Vs (m) (n+1)). An electric charge of an amount corresponding to the source voltages (Vs(m) (n), Vs(m) (n+1)) is stored in the liquid crystal (capacitor 221) and the auxiliary capacitor 222.

The liquid crystal panel 218 is significantly deteriorated when the same voltage is continuously applied. Therefore, the deterioration of the liquid crystal panel 218 is prevented by changing the polarity of the drain voltage Vd (alternating current drive) at every constant period ( for example, one frame). The brightness of the liquid crystal panel 218 remains the same irrespective of whether the polarity of the drain voltage is positive or negative if the effective value of the difference between the drain voltage (Vd) and the reference voltage (vcen) stays the same. Accordingly, it is possible to perform the display by alternating current driving.

The counter electrodes 223 are arranged on the side of the glass substrate 401 in the liquid crystal panel 218 and therefore, all the pixels 219 included in one row share one counter electrode 223 (in other words, the electric potentials of the counter electrodes 223 become the same). Similarly, all the pixels 219 included in one column share a drain line (in other words, the potentials of the drain electrodes become the same). Therefore, the generation of flicker is prevented by changing the polarities of the drain voltages Vd at every contiguous pixel 219. When the positive drain voltage (for example, VdB2) is applied on the drain lines Dn at odd number columns, a negative drain voltage (for example, VdB1) is applied on the drain lines D(n+1) at even number columns.

It is necessary for the signal drive circuits 206 and 207 to have a capacity for generating both the positive drain voltage (VdB2) and the negative drain voltage (VdB1) to obtain the above-described drive system. Therefore, the voltage resistance capability required for the signal drive circuits 206 and 207 becomes greater. For example, assuming a case in which the potential difference between the drain voltages VdB1 and VdW1 is a voltage level (approximately 5 V) of a general purpose logic circuit, a voltage resistance capability of 10 V or more is necessary for the signal drive circuits 206 and 207. As a result, the price of the signal drive circuits 206 and 207 or the price of the liquid crystal display device is increased.

SUMMARY OF THE INVENTION

It is an object of the present invention to provide a TFT liquid crystal panel and a liquid crystal display device capable of using a low cost signal drive circuit while achieving a high quality display without generation of flicker.

According to an aspect of the present invention, a liquid crystal panel comprises a transparent first substrate, a second substrate arranged opposing the first substrate, liquid crystals filled between the first substrate and the second substrate, pixels including TFTs each having a gate electrode, a drain electrode and a source electrode, pixel electrodes connected to the source electrodes and counter electrodes and arranged in M rows and N columns, drain lines independently provided for respective columns and connected to the drain electrodes of the pixels for the respective columns, counter lines connected to the counter electrodes and gate lines independently provided for respective rows and connected to the gate electrodes of the pixels for the respective rows, wherein a twist angle of the liquid crystals changes in a plane in parallel with a direction of an electric field, and wherein both the pixel electrodes and the counter electrodes are provided at the second substrate.

In accordance with a feature of the present invention, the counter lines include the counter lines at odd number columns connected to the counter electrodes of the pixels for the odd number columns and the counter lines at even number columns connected to the counter electrodes of the pixels for the even number columns, and the counter lines at the odd number columns and the counter lines at the even number columns are independent from each other.

According to another aspect of the present invention, a liquid crystal display device comprises the above-mentioned liquid crystal panel, a counter electrode drive arrangement for forming counter electrode voltages and applying the counter electrode voltages on the counter lines, a gate drive arrangement for successively selecting one of the gate lines and applying a select voltage on the selected gate line and a nonselect voltage on unselected gate lines, thereby applying the select voltage on the respective gate electrodes at every one frame period and a drain drive arrangement for forming a positive drain voltage having a voltage level higher than the counter electrode voltages and a negative drain voltage having a voltage level lower than the counter electrode voltages with respect to one display data for alternately applying the positive drain voltage and the negative drain voltage on the drain lines at every one frame period.

According to a feature of the present invention, the counter electrode drive arrangement is capable of forming a high level counter electrode voltage and a low level counter electrode voltage having a voltage level lower than a voltage level of the high level counter electrode voltage as the counter electrode voltages, the counter electrode drive arrangement applies alternately the high level counter electrode voltage and the low level counter electrode voltage on the odd number column counter lines and applies alternately the low level counter electrode voltage and the high level counter electrode voltage having phases which are reverse to phases of the low level counter electrode voltage and the high level counter electrode voltage applied on the odd number column counter lines on the even number column counter lines, and the drain drive arrangement applies the negative drain voltage on the drain lines corresponding to the counter lines on which the high level counter electrode voltage is applied and applies the positive drain voltage on the drain lines corresponding to the counter lines on which the low level counter electrode voltage is applied.

In accordance with another feature of the present invention, it is preferable to provide the liquid crystal panel with the counter lines which include the counter lines at odd number rows connected to the counter electrodes of the pixels for the odd number rows and the counter lines at even number rows connected to the counter electrodes of the pixels for the even number rows, and that the counter lines at the odd number rows and the counter lines at the even number rows are independent from each other.

According to a further aspect of the present invention, a liquid crystal display device comprises the above-described liquid crystal panel, a counter electrode drive arrangement for forming counter electrode voltages and applying the counter electrode voltages on the counter lines, a gate drive arrangement for successively selecting one of the gate lines and applying a select voltage on the selected gate line and a nonselect voltage on the unselected gate lines, thereby applying the select voltage on respective gate electrodes at every one frame period, and a drain drive arrangement for forming a positive drain voltage having a voltage level higher than the counter electrode voltages and a negative drain voltage having a voltage level lower than the counter electrode voltages with respect to one display data for alternately applying the positive drain voltage and the negative drain voltage at every other row.

In accordance with a feature of the present invention, it is preferable that the counter electrode drive arrangement is capable of forming a high level counter electrode voltage and a low level counter electrode voltage having a voltage level lower than a voltage level of the high level counter electrode voltage as the counter electrode voltages, the counter electrode drive arrangement applies alternately the high level counter electrode voltage and the low level counter electrode voltage on the odd number row counter electrodes and applies the low level counter electrode voltage and the high level counter electrode voltage having phases which are reverse to phases of the low level counter electrode voltage and the high level counter electrode voltage applied on the odd number column counter lines on the even number row counter electrodes, and the drain drive arrangement applies the negative drain voltage on the drain lines when the gate line corresponding to the counter line on which the high level counter electrode voltage is applied is selected and applies a positive drain voltage on the drain lines when the gate line corresponding to the counter line on which the low level counter electrode voltage is applied is selected.

In accordance with a feature of the present invention, it is preferable to provide the liquid crystal panel with the counter lines which include first counter lines connected to the counter electrodes of the pixels for odd number rows and odd number columns and for even number rows and even number columns and second counter lines connected to the counter electrodes of the pixels for even number rows and odd number columns and for odd number rows and even number columns, and that the first counter lines and the second counter lines are independent from each other.

According to another aspect of the present invention, a liquid crystal display device comprising the above-described liquid crystal panel, a counter electrode drive arrangement for forming a counter electrode voltage and applying the counter electrode voltage on the counter lines, a gate drive arrangement for successively selecting one of the gate lines of the liquid crystal panel and applying a select voltage on the selected gate line and nonselect voltage on the unselected gate lines, thereby applying the select voltage on respective gate electrodes at every one frame period, and a drain drive arrangement for forming a positive drain voltage having a voltage level higher than the counter electrode voltages and a negative drain voltage having a voltage level lower than the counter electrode voltages with respect to one display data for alternately applying the positive drain voltage and the negative drain voltage on the drain lines at every other row.

In accordance with a feature of the present invention, it is preferable to provide the counter electrode drive arrangement for forming a high level counter electrode voltage and a low level counter electrode voltage having a voltage level lower than a voltage level of the high level counter electrode voltage as the counter electrode voltages, the counter electrode drive arrangement applies alternately the high level counter electrode voltage and the low level counter electrode voltage on the first counter electrodes and applies the low level counter voltage and the high level counter electrode voltage having phases which are reverse to phases of the low level counter voltage and the high level counter voltage applied on the first counter electrodes on the second counter electrodes, and with respect to the respective pixels for the selected row, the high level counter electrode voltage is applied on the counter electrodes corresponding to the pixels, the drain drive arrangement applies the negative drain voltage on the drain lines corresponding to the pixels and applies the positive drain voltage on the drain lines corresponding to the pixels where the low level counter electrode voltage is applied on the counter electrodes corresponding to the pixels.

In accordance with another feature of the present invention, it is preferable to provide the above-described liquid crystal display device so that a difference between the positive drain voltage and the negative drain voltage is less than 5 V.

According to a further feature of the present invention, it is preferable that in case where the entire liquid crystal panel is viewed with respect to a thickness direction of the liquid crystal panel, a first region between the pixel electrodes and the counter electrodes is transparent and a second region other than the first region is opaque. It is also preferable that at least one of the pixel electrodes and the counter electrodes is transparent.

In the liquid crystal panel according to the present invention, it is possible to provide the pixel electrodes and the counter electrodes on the same side (the second substrate) by utilizing liquid crystals filled between the substrates having a twist angle which is changed in a plane in parallel with the direction of the electric field. When the liquid crystal panel is used as a transmitting type, in case where the entire panel is viewed with regard to the thickness direction of the liquid crystal panel, a region between the pixel electrode and the counter electrode (that is, a region in which the electric field is in parallel with the liquid crystal panel and the light transmittance is changed by the liquid crystals) becomes transparent and the other region (that is, a region in which the light transmittance is not changed by the liquid crystals) becomes opaque. At least one of the pixel electrode and the counter electrode may be made opaque.

Various types of counter lines can be considered in the construction of the counter lines in the above-described liquid crystal panel, and the structure of the liquid crystal display device becomes different in accordance thereto.

When the counter lines are constituted by classification as odd number column counter lines and even number column counter lines independent from each other, the drain drive arrangement and the counter electrode drive arrangement operate as follows. The drain drive arrangement applies alternately the positive drain voltage and the negative drain voltage on the drain lines at every one frame period. The counter electrode drive arrangement applies alternately the high level counter electrode voltage and the low level counter electrode voltage on the odd number column counter lines. Meanwhile, the counter electrode drive applies alternately the low level counter electrode voltage and the high level counter electrode voltage having phases which are reverse to phases of those of the odd number column counter lines on the even number column counter lines. In this case, the drain drive arrangement applies the negative drain voltage on the drain lines corresponding to the counter lines on which the high level counter electrode voltage is applied and the positive drain voltage is applied on the drain lines corresponding to the counter lines on which the low level counter electrode voltage is applied.

When the counter lines are constituted by classification as odd number row counter lines and the even row number counter lines independent from each other, the drain drive arrangement and the counter electrode drive arrangement operate as follows. The drain drive arrangement applies the positive drain voltage and the negative drain voltage on the drain lines alternately row by row. The counter electrode drive arrangement applies alternately the high level counter electrode voltage and the low level counter electrode voltage on the odd number row counter electrodes. Meanwhile, the counter electrode drive arrangement applies the low level counter electrode voltage and the high level counter electrode voltage having phases which are reverse to phases of the odd number row counter electrodes on the even number row counter electrodes. In this case, the drain drive arrangement applies the negative drain voltage on the drain lines when the gate lines corresponding to the counter lines on which the high level counter electrode voltage is applied are selected. Meanwhile, the positive drain voltage is applied on the drain lines when the gate lines corresponding to the counter lines on which the low level counter electrode voltage is applied are selected.

When the counter lines are constituted by classification as first counter lines and the second counter lines independently, the drain drive arrangement and the counter electrode drive arrangement operate as follows. The drain drive arrangement applies the positive drain voltage and the negative drain voltage on the drain liens alternately row by row. The counter electrode drive arrangement applies alternately the high level counter electrode voltage and the low level counter electrode voltage on the first counter electrodes. Meanwhile, the low level counter electrode voltage and the high level counter electrode voltage having phases which are reverse to phases of those of the first counter electrodes are applied on the second counter electrodes. In this case, the drain drive arrangement further applies the negative drain voltage on the drain lines corresponding to the pixels when the high level counter electrode voltage is applied on the counter electrode corresponding to the pixels with regard to each of the pixels for the selected row. Meanwhile, in a case where the low level counter electrode voltage is applied on the counter electrode corresponding to the pixels, the positive drain voltage is applied on the drain lines corresponding to the pixels. In the above-mentioned aspects of the liquid crystal device, not only the drive electrodes but the counter electrodes are driven by alternating currents and therefore, the voltage difference between the positive drain voltage and the negative drain voltage may be smaller than 5 V.

These and other objects, features and advantages of the present invention will become more apparent from the following description when taken in conjunction with the accompanying drawings.

DESCRIPTION OF THE PREFERRED EMBODIMENTS

Figure 1:
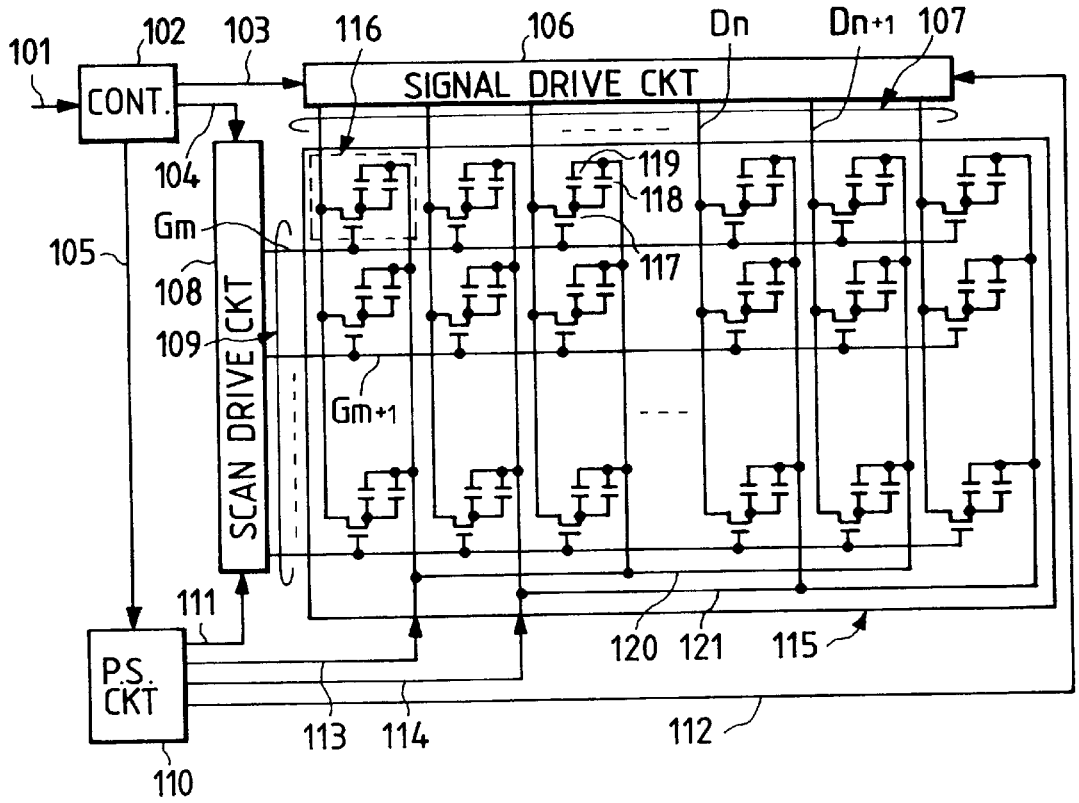
FIG. 1 is a shows primarily in block diagram a TFT liquid crystal display device according to an embodiment of the present invention.

Referring now to the drawings wherein like reference numerals are utilized to designate like parts, a liquid crystal display device is illustrated in FIG. 1 and described with reference to FIG. 1 through FIG. 6. As shown in FIG. 1, a liquid crystal display device according to an embodiment of the present invention includes a liquid crystal controller 102, a signal drive circuit 106, a scan drive circuit 108, a power source circuit 110 and a TFT liquid crystal panel 115. Further, the device includes signal buses 101, 103, 104 and 105, a drain bus 107, a gate bus 109, and power source buses 111, 112, 113 and 114 for sending and receiving various signals, voltages and the like between these members (or to and from the outside).

Figure 2:
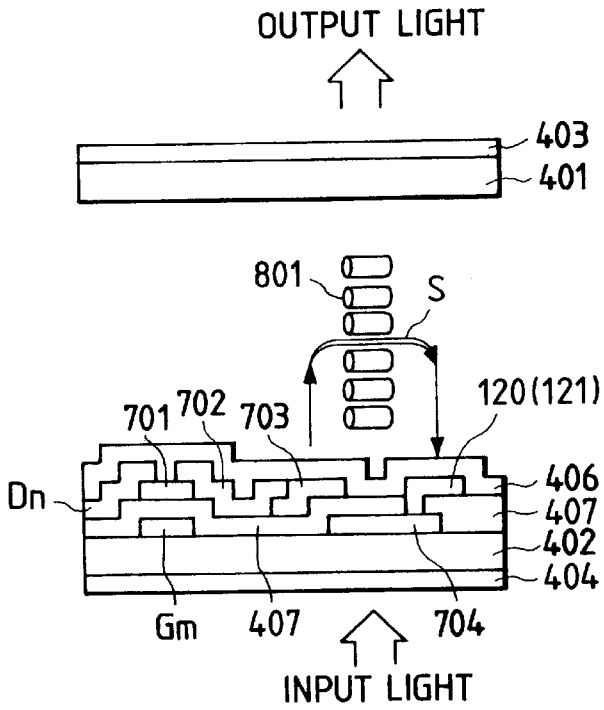
FIG. 2 is a schematic view showing the internal structure of a liquid crystal panel of FIG. 1.
Figure 3:
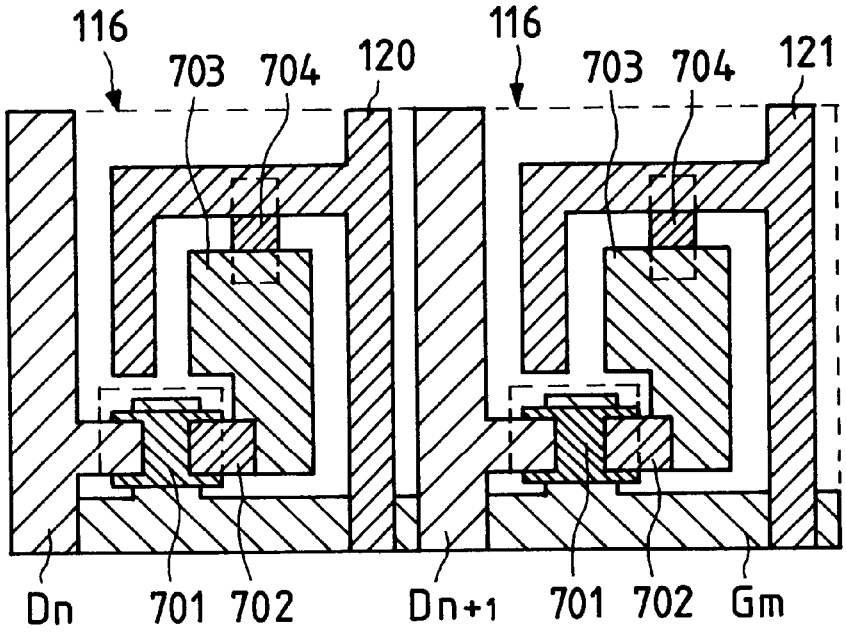
FIG. 3 is an enlarged plane view of a pixel of FIG. 1.

The TFT liquid crystal panel 115 is constituted by the drain bus 107 including N drain lines D and the gate bus 109 including M gate lines G intersected to each other in a matrix form. Pixels 116 are formed at the respective intersection points. Accordingly, the TFT liquid crystal panel 115 is provided with N×M of the pixels 116. Hereinafter, the gate line at the m-th row is designated by "Gm" and the gate line at the m+1-th row is designated by "Gm+1." Similarly the drain line at the n-th column is designated by "Dn" and the drain line at the n+1-th column is designated by "Dn+1." The pixel 116 is provided with a liquid crystal which is equivalently represented as a capacitor 118 and an auxiliary capacitor 119. Further, the pixel is provided with a TFT 117, and as shown in FIGS. 2 and 3, a pixel electrode 703, a counter electrode 120 or 121 and an auxiliary capacitor electrode 704 as circuits for applying predetermined voltages thereto.

In the TFT liquid crystal panel 115 an orientation state of liquid crystal molecules is maintained by storing an electric charge in the liquid crystal 118 and in the auxiliary capacitor 119. The TFT 117 is a switch for controlling the charge/discharge of electric charge to and from the liquid crystal 118 and the auxiliary capacitor 119. The application of voltage on the liquid crystal 118 is provided by a difference between potentials of the pixel 703 and the counter electrode 120 or 121. The auxiliary capacitor 119 is provided to reduce leakage current from the liquid crystal 118. The application of voltage on the auxiliary capacitor 119 is provided by a difference between potentials of the auxiliary capacitor electrode 704 and the pixel electrode 703. The auxiliary capacitor electrode 704 and the counter electrode 120 or 121 are in a conductive state and its potential is equal to the potential of the corresponding counter electrode 120 or 121.

In this embodiment, the counter electrodes are classified as counter electrodes at odd number columns and counter electrodes at even number columns. The counter electrodes 120 are connected only to the pixels 116 at odd number columns and the counter electrodes 121 are connected only to the pixels 116 at even number columns. Thereby, in the liquid crystal panel 115, counter electrode voltages (Vcom), can be controlled in accordance with classification thereof as the pixels 116 belonging to odd number columns and as the pixels 116 belonging to even number columns independently from each other, as later described. Further, as later described, in the liquid crystal panel 115 of this embodiment, both of the pixel electrodes 703 and the counter electrodes 120 and 121 are arranged, as shown in FIG. 2, on a side of the liquid crystal panel at which a glass substrate 402 is provided.

The liquid crystal controller 102 converts display data and synchronizing signals supplied from a system (not shown) via the signal bus 101 in compliance with the signal drive circuit 106 and the scan drive circuit 108. The liquid crystal controller 106 outputs liquid crystal display data and liquid crystal drive signals after conversion to the signal drive circuit 106 via the signal bus 103. Further, the controller similarly outputs predetermined liquid crystal drive signals to the scan drive circuit 108 via the signal bus 104. The signal drive circuit 106 outputs drain voltages (Vd) corresponding to the display data inputted from the liquid crystal controller 102 to the pixel electrodes 703 via the drain lines D and the TFTs 117. The scan drive circuit 108 applies gate voltages (Vg) determined in accordance with signals inputted from the liquid crystal controller 102 to the gate electrodes of the TFTs 117 via the gate lines G. The gate voltages (Vg) are outputted for successively selecting the pixels in one horizontal line which is being written or displayed.

The power source circuit 110 supplies the above-mentioned various members with various voltages necessary for driving the liquid crystal panel display. The power source circuit 110 supplies power source voltages to the scan drive circuit 108 via the power source bus 111 and to the signal drive circuit 107 via the power source bus 112. The power source circuit 110 also supplies counter electrode voltages (Vcom) to the counter electrodes 120 and 121. In this embodiment, the supply of the counter electrode voltages is provided in accordance with the classification thereof as the counter electrodes 120 at odd number columns and as the counter electrodes 121 at even number columns. That is, a counter electrode voltage (VcomOD) is outputted to the counter electrodes 120 via the power source bus 113 and a counter electrode voltage (VcomED) is outputted to the counter electrodes 121 via the power source bus 114. Further, the power source circuit 110 can output two kinds (high level (VcomH)/low level (VcomL)) of voltage levels as the counter electrode voltages. An auxiliary capacitor voltage (Vstg) is supplied to the auxiliary capacitor electrodes 704, as shown in FIGS. 2 and 3, also via the power source buses 113 and 114.

As shown in FIG. 2, the liquid crystal panel 115 is constituted by glass substrates 401 and 402, polarizing films 403 and 404, an orientation film 406, an insulating film 407 and liquid crystal molecules 801. The liquid crystal panel also includes the TFTs 117, the gate lines G, the drain lines D, the counter electrodes 120 and 121, the auxiliary capacitor electrodes 704 and the pixel electrodes 703. The glass substrate 401 and the glass substrate 402 oppose each other in parallel maintaining a predetermined distance. Further, the liquid crystal molecules 801 are filled therebetween. The liquid crystal molecules in the present embodiment differ from those utilized in conventional embodiments in that the twist angle of the liquid crystal molecules 801 changes in a plane in parallel with the gradient direction of an electric field, as described in Japanese Patent Application No. 46806/1994.

Figure 22:
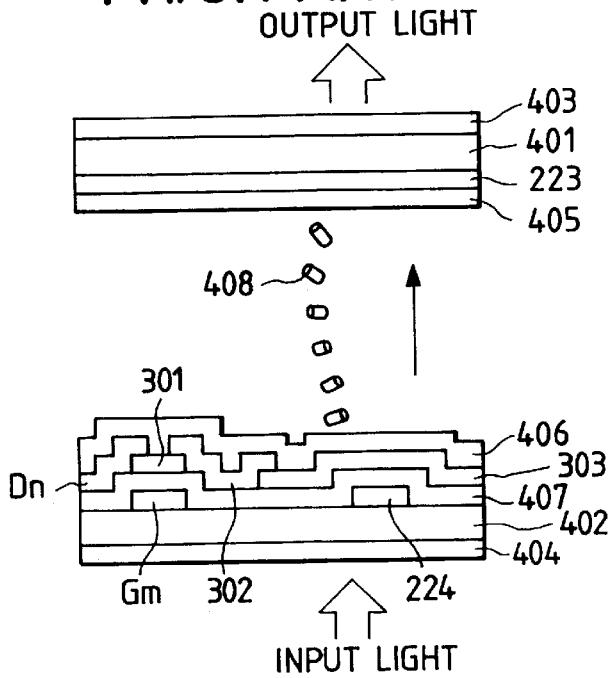
FIG. 22 PRIOR ART
FIG. 22 is a schematic view showing the internal structure of a conventional liquid crystal panel of FIG. 21.
Figure 23:
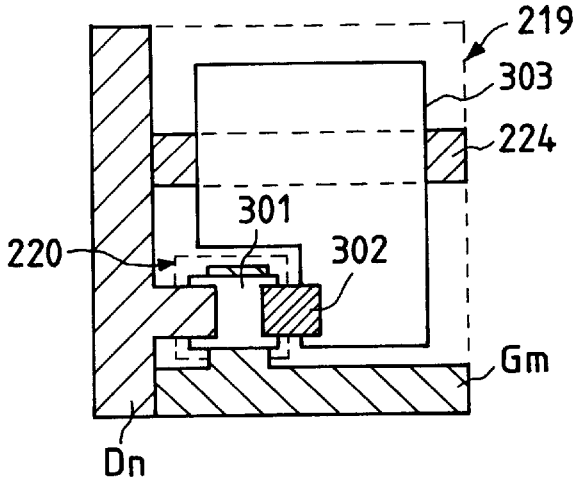
FIG. 23 PRIOR ART
FIG. 23 is an enlarged plane view of a conventional pixel of FIG. 21.
Figure 24:
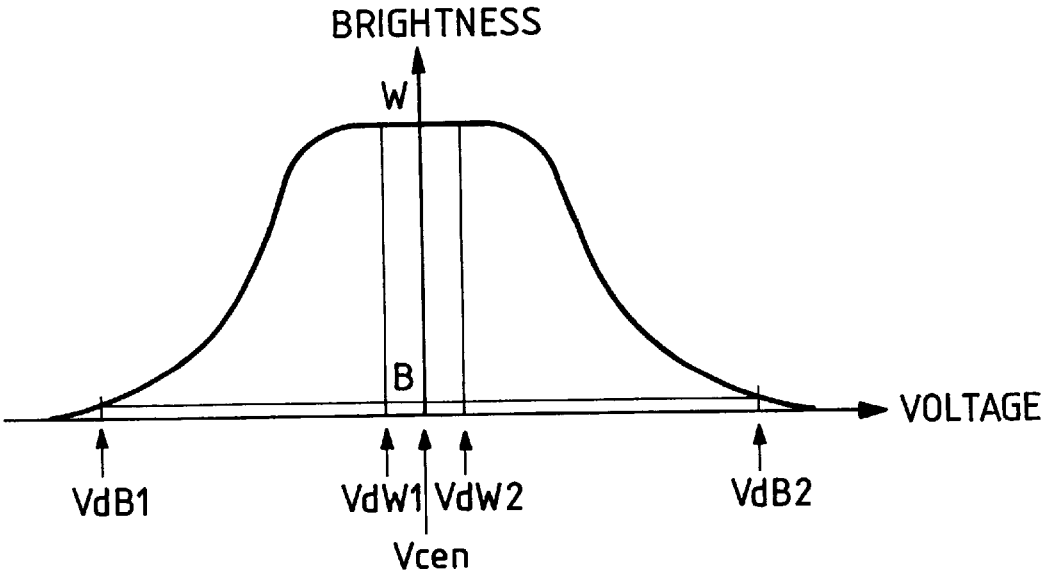
FIG. 24 PRIOR ART
FIG. 24 is a voltage/brightness characteristic diagram of a conventional liquid crystal of the device of FIG. 21.
Figure 25A:
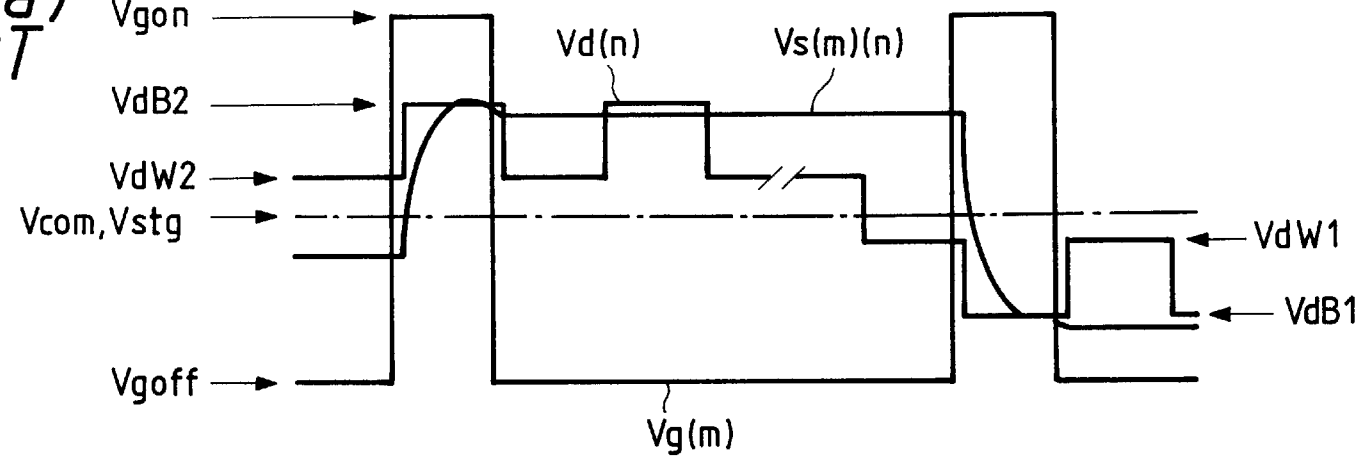
FIG. 25(a) PRIOR ART
FIGS. 25(*a*) and 25(*b*) show conventional liquid crystal drive waveform diagrams of the device of FIG. 21.
Figure 25B:
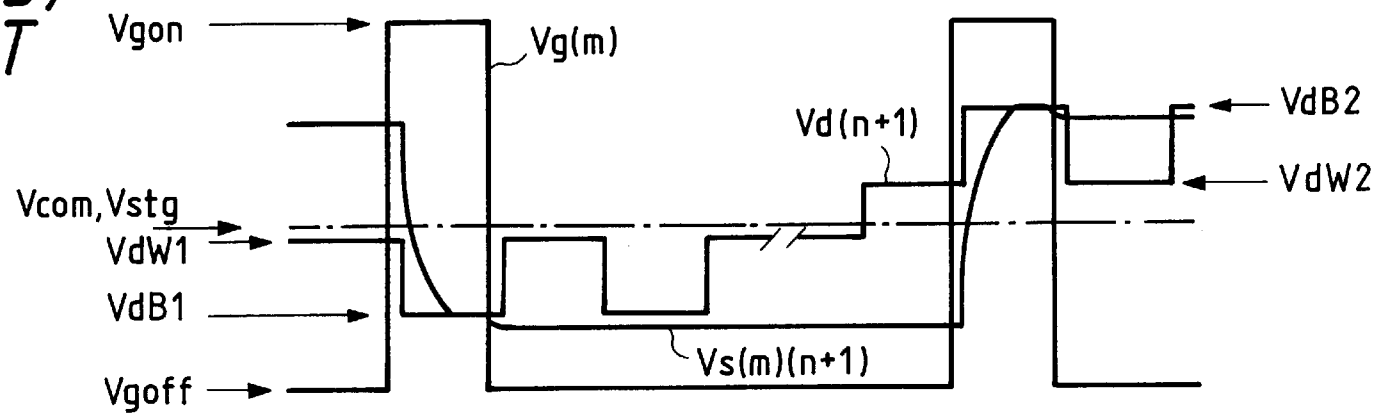
FIG. 25(b) PRIOR ART

Further, another difference in this embodiment from that of conventional embodiments, is that the counter electrodes 120 and 121 are installed on the side of the glass plate 402, that is, on the side of the pixel electrodes 703, as shown in FIG. 2. The direction of the electric field occurring between the counter electrode 120 or 121 and the pixel electrode 704 corresponding thereto, is designated by an arrow mark in FIG. 2. As shown in FIG. 2, there is a portion in the direction of the electric field which is in parallel with the panel face (the glass substrate face) is designated by the void in the arrow mark S. Accordingly, there is obtained a liquid crystal panel structure wherein the counter electrodes and the pixel electrodes are provided on the same side and the twist angle of the liquid crystal molecules 801 changes only in a plane in parallel with the panel face in accordance with the strength of applied voltage. Further, the liquid crystal molecules 801 are oriented such that their long axes are positioned in a plane in parallel with the panel face by their own property even if there is no orientation film 405 as provided in FIG. 22.

The TFT 117 is provided on the glass substrate 402. As shown in FIG. 3 the TFT 117 is constituted by a silicon portion 701, a gate electrode, a drain electrode and a source electrode 702 connected to the pixel electrode 703. Actually, the gate electrode is constituted by the gate line G and the drain electrode is constituted by the drain line D. Further, an insulating film 407 pinched by the pixel electrode 703 and the auxiliary capacitor electrode 704 operates as the auxiliary capacitor 119.

The liquid crystal panel 115 for this embodiment is of a transmitting type. Therefore, portions in the above-described members in which the light transmittance cannot be changed by the twist angle of the liquid crystal molecules 801 (that is, portions where the potential gradient in a direction in parallel with the panel face of the liquid crystals are not present) must be opaque. Further, portions where the light transmittance can be changed by the twist angle (direction) of the liquid crystal molecules 801 must be transparent. More specifically, a portion where the light transmittance can be changed is a region between the pixel electrode 703 and the counter electrode 120 or 121 in one pixel. Accordingly, the insulating film 407, the auxiliary capacitor electrode 704 and the orientation film 406 are transparent. The drain line D, the gate line G, the silicon portion 701, the source electrode 702, the pixel electrode 703 and the counter electrode 120 or 121 are made opaque. The polarizing plates 403 and 404 are semitransparent. In viewing the entire liquid crystal panel with regard to the thickness direction of the liquid crystal panel, it is sufficient that the enumerated portions are opaque. However, with regard to the portions to be opaque, it is not necessary that all of the portions enumerated have to be opaque. For example, with regard to a liqui crystal panel of a reflection type to which the present invention is applicable, the counter electrode 120 or 121, the pixel electrode 703 and the like may be transparent.

Figure 4:
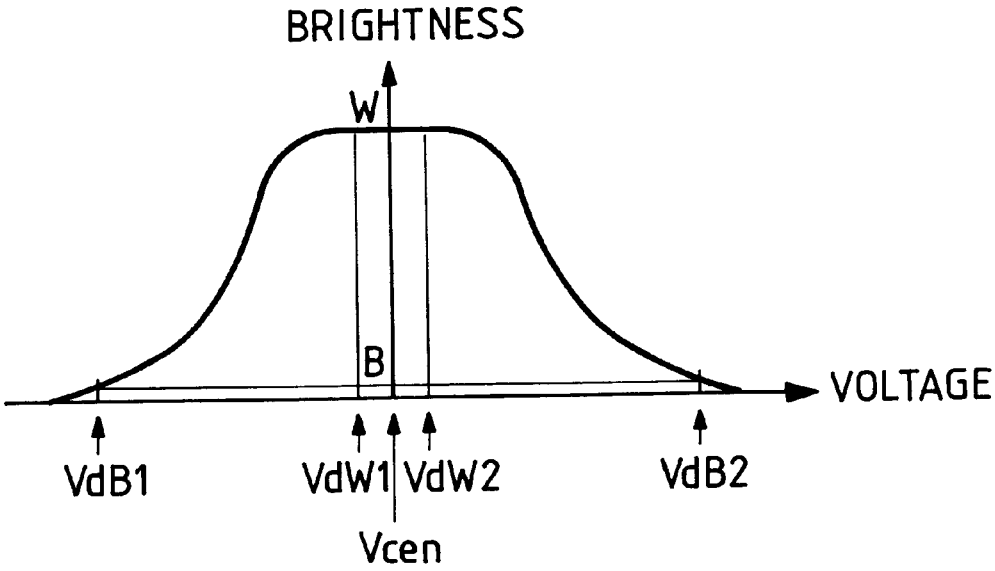
FIG. 4 is a voltage/brightness characteristic diagram of a liquid crystal in accordance with FIG. 1.

The operation of the liquid crystal panel 115 is described with reference to FIG. 4 and FIGS. 5(*a*) and 5(*b*) wherein FIG. 4 shows voltage/brightness characteristic of the liquid crystal and the abscissa designates a voltage value and the ordinate designates a brightness with the following notations being utilized.

Vcen: Reference voltage value (equivalent to counter electrode voltage Vcom);

VdB1: Voltage level for negative black display (potential);

VdW1: Voltage level for negative white display (potential);

VdW2: Voltage level for positive white display (potential); and

VdB2: Voltage level for positive black display (potential).

Figure 5A:
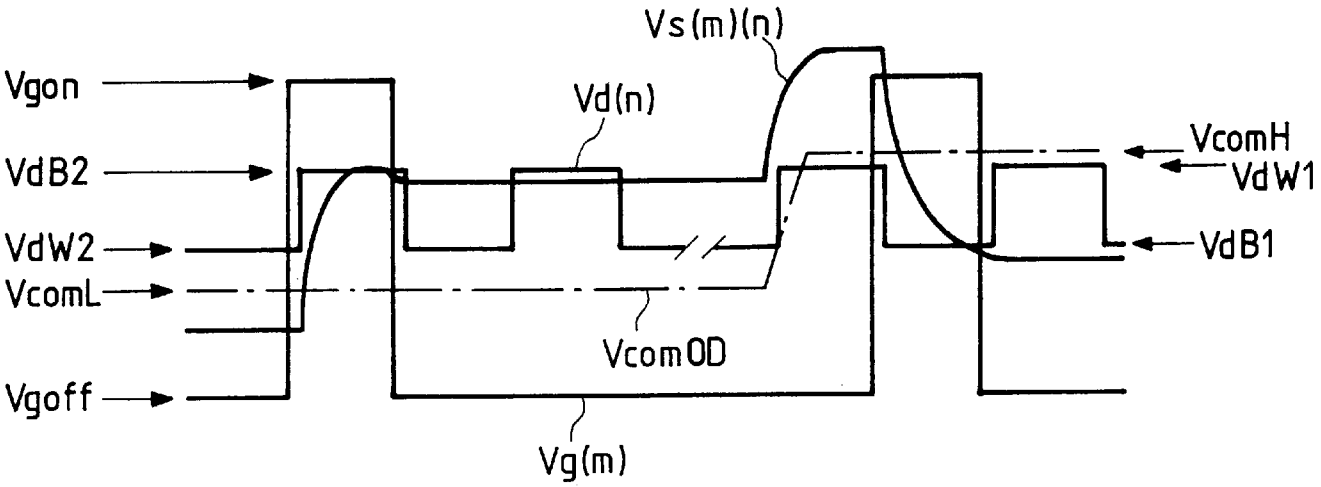
FIGS. 5(*a*) and 5(*b*) show drive waveforms of the liquid crystal display device of FIG. 1.
Figure 5B:
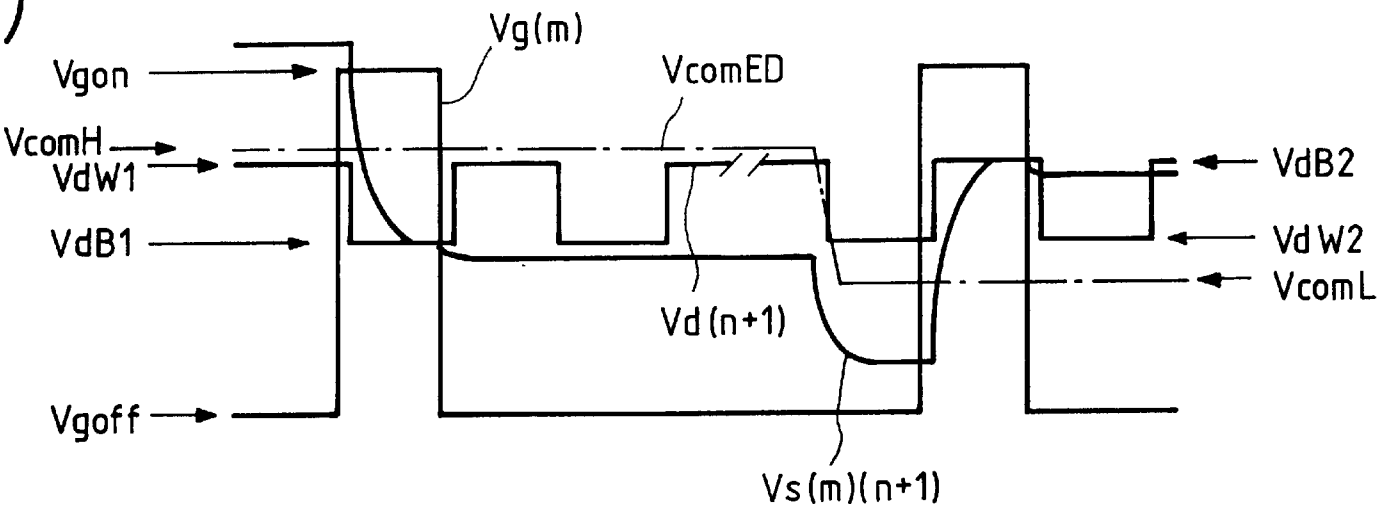

FIGS. 5(*a*) and (*b*) show drive voltage waveforms in one frame period where the counter electrode voltage (Vcom)= the auxiliary capacitor electrode voltage (Vstg)=the reference voltage (Vcen). The waveforms shown in FIGS. 5(*a*) and 5(*b*) perform black/white display row by row and perform black display at a selected m-th row. In FIGS. 5(*a*) and 5(*b*), portions are designated utilizing the following notations.

Vg(m): Voltage waveform applied on gate line Gm;

Vd(n): Voltage waveform applied on drain line Dn;

Vd(n+1): Voltage waveform applied on drain line Dn+1;

Vs(m)(n): Waveform of a pixel voltage (hereinafter, "source voltage") applied on the liquid crystal 118 of a pixel at the m-th row, n-th column;

Vs(m)(n+1): Waveform of a pixel voltage (hereinafter, "source voltage") applied on the liquid crystal 118 of a pixel at the m-th row, n+1-th column;

VcomOD: Voltage waveform of the counter electrode at odd number column;

VcomED: Voltage waveform of the counter electrode at even number column;

VcomH: High level counter electrode voltage; and

VcomL: Low level counter electrode voltage.

The liquid crystal controller 102 converts display data and synchronizing signals transmitted through the signal bus 101 into liquid crystal data and liquid crystal drive signals for driving the TFT liquid crystal panel 115. The liquid crystal controller supplies the appropriate signals respectively to the signal drive circuit 106 via the signal bus 103 and to the scan drive circuit 108 via the signal bus 104. Further, the liquid crystal controller also supplies predetermined signals to the power source circuit 110 via the signal bus 105.

The signal drive circuit 106 successively receives liquid crystal display data sent via the signal bus 103. When the signal drive circuit 106 has finished receiving the liquid crystal display data of one horizontal line, the signal drive circuit 106 simultaneously outputs the drain voltages (Vd) corresponding to the received liquid crystal display data to the drain bus 107 in synchronism with similarly sent synchronizing signals. The signal drive circuit 106 continues outputting the drain voltage during one horizontal period. Each of the drain voltages Vd is naturally determined for each drain line in correspondence with the display data. In parallel with outputting of the drain voltages (Vd) the signal drive circuit 106 successively receives liquid crystal display data of a next line. The signal drive circuit 106 form the drain voltages in correspondence with the liquid crystal display data of one frame by repeating this operation during one frame period.

In the liquid crystal panel 115, the twist angle of the liquid crystal molecules 801 present at each pixel portion, that is, the transmittance of the pixel is changed by controlling the electric field at each pixel 116. As previously described, there are portions wherein the gradient of the electric field driving the liquid crystal molecules 801 is in a direction in parallel with the liquid crystal panel by installing both of the counter electrodes 120 or 121 and the pixel electrodes 703 on the side of the glass plate 402. The electric field is controlled by controlling a voltage difference between the drain voltage applied on the pixel electrode 703 and the voltage applied on the counter electrode 120 or 121. As shown in FIG. 4, in a case where the applied voltage difference is large, the transmittance is lowered and the pixel becomes dark. However, in a case where the applied voltage difference is small, the transmittance is enhanced and the pixel becomes bright.

The application of the drain voltage Vd on the pixel electrode 703 is provided by successively applying a select voltage (Vgon) on the gate line G of the gate bus 109 by the scan drive circuit 108 in synchronism with outputting of the drain voltage Vd to the drain bus 107 by the signal drive circuit 106.

When the ON voltage (Vgon) is applied on the gate line Gm, the drain voltages Vd(n) and Vd(n+1) applied on the drain lines Dn and Dn+1, are applied on the pixel electrodes 703 at the m-th row via the TFTs 117. Further, differences between the drain voltages (Vd(n), Vd(n+1)) applied at this time and the counter electrode voltage (vcom) become the source voltages (vs(m)(n), Vs(m)(n+1)) at this time. An electric charge having an amount corresponding to the source voltages (Vs(m)(n), Vs(m)(n+1)) is stored in the liquid crystal (capacitor) 118 and the auxiliary capacitor 119.

In this embodiment, an alternating current is formed by switching the voltage level of the counter electrode voltage Vcom between the high level (VcomH) and the low level (VcomL) frame by frame. The voltage level of the counter electrode 120 at an odd number column (FIG. 5(*a*)) and the voltage level of the counter electrode 121 at an even number column (FIG. 5(*b*)) are controlled independently from each other. That is, when the voltage level of the counter electrode voltage VcomOD at an odd number column is at low level (VcomL), the voltage level of the counter electrode voltage VcomED at an even number column is made to be a high level (VcomH). Conversely, when the voltage level of the counter electrode voltage VcomOD at the odd number column is at high level (VcomH), the voltage level of the counter electrode voltage VcomED at the even number column is made to be at a low level (VcomL). Such a control of the counter voltages is performed by the power source circuit 110.

Further, the signal drive circuit 106 changes the polarity (positive/negative) of the drain voltage Vd in correspondence with the control of the above-mentioned counter voltage (Vcom). That is, the negative drain voltage Vd is applied on the drain line D on which the high level counter electrode voltage (VcomH) is applied. Meanwhile, the positive drain voltage Vd is applied on the drain line D on which the low level counter electrode voltage (VcomL) is applied. The "positive drain voltage" corresponds to a drain voltage having a voltage level higher than the low level counter electrode voltage VcomL, that is, VdW2 and VdB2 in FIG. 4 and FIGS. 5(*a*) and 5(*b*). The "negative drain voltage" corresponds to the drain voltage having a voltage level lower than the high level counter electrode voltage (VcomH), that is, VdW1 and VdB1 in FIG. 4 and FIGS. 5(*a*) and 5(*b*). The control of the drain voltage is performed independently with regard to the drain buses Dn at odd number columns and the drain lines D(n+1) at even number columns. Therefore, when, for example, the positive drain voltage (VdB2) is being outputted to the drain bus Dn at an odd number column, the negative drain voltage (VdB1) is outputted to the drain bus D(n+1) at an even number column.

By controlling the counter electrode voltage Vcom and the drain voltage Vd as described above, with regard to one pixel 116, the positive voltage and the negative voltage can alternately be applied frame by frame. Therefore, deterioration of the liquid crystal 118 can be prevented. Further, when viewing the entire panel, the polarity of the voltage applied on the pixels 116 is reversed at every row even during one frame. Accordingly, the polarity of the applied voltage becomes uniform with respect-to the entirety of the panel and a high voltage display without flicker is obtainable.

Figure 6:
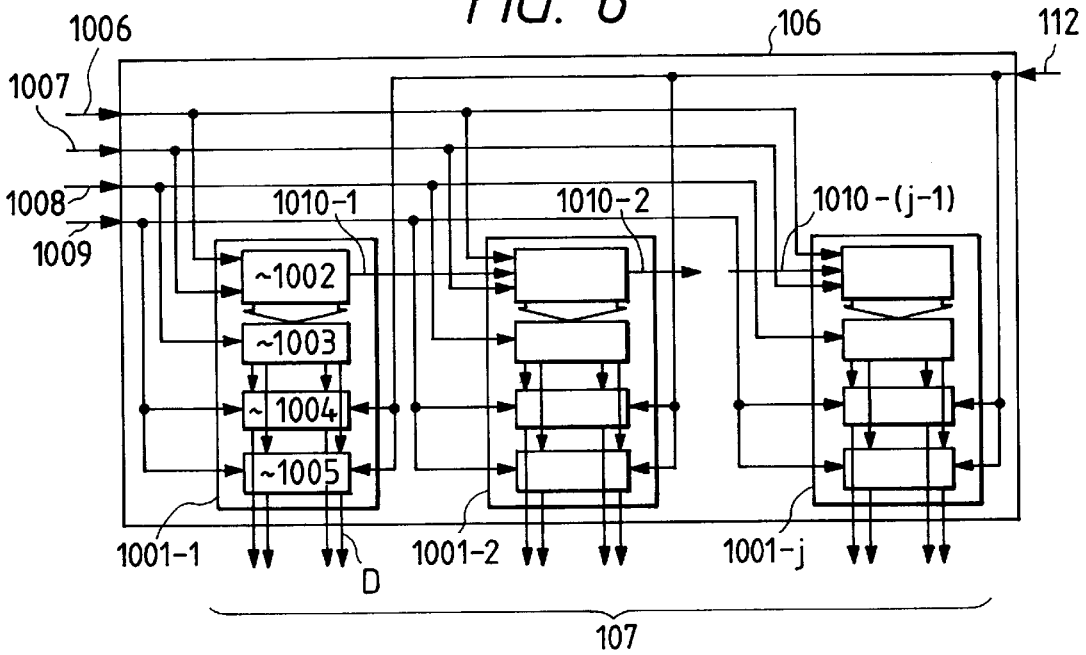
FIG. 6 is a block diagram showing the internal structure of a signal drive circuit of FIG. 1.

As shown in FIG. 6, the signal drive circuit 106 includes a plurality of signal driver buses 1001 and signal lines 1006, 1007, 1008, 1009 and 1010 for supplying the various signal drivers with various signals. A J-th signal driver among the signal drivers 1001 is designated as "signal driver 1001-j." The signal driver 1001 is constituted by a shift resistor 1002, a latch circuit 1003 and digital/analog conversion circuits 1004 and 1005. The digital/analog conversion circuit 1004 corresponds to a drain line of an odd number order in the drain bus 107 and the digital/analog conversion circuit 1005 corresponds to a drain line of an even number order.

The data bus 1006 is provided for supplying display data sent from the liquid crystal controller 102 to the shift resister 1002. The signal line 1007 is provided for supplying data shift clocks sent from the liquid crystal controller 102 to the shift resister 1002. The signal line 1008 is provided for supplying data latch clocks sent from the liquid crystal controller 102 to the latch circuit 1003. The signal line 1009 is provided for supplying liquid crystal alternating current forming signals sent from the liquid crystal controller 102 to the digital/analog conversion circuits 1004 and 1005. Each of the bus 1006 and the signal lines 1007, 1008 and 1009 is included in the signal bus 103 of FIG. 1.

The signal line 1010 is provided for sending enable signals for controlling operational timings among the respective signal drivers 1006. The enable signal of each signal driver 1006 is outputted to the signal driver 1006 located contiguously on the right of the figure. The signal driver 1001 operates in the following manner. When an enable signal 1010 becomes effective, the shift resister 1002 successively receives liquid crystal display data 1006 in synchronism with a data shift clock 1007. A data latch clock 1008 becomes effective when the liquid crystal display data of one horizontal line has been received by the shift resisters 1002 of all the signal drivers (1001-1 through 1001-j). Thereby the liquid crystal display data of one horizontal line is latched by the latch circuits 1003 of the signal drivers 1001-1 to 1001-j.

The digital/analog conversion circuits 1004 and 1005 convert the liquid crystal display data into a liquid crystal drive voltage (drain voltage) and continue outputting the liquid crystal drive voltage via the drain bus 107 during one horizontal period. In the meantime, the shift resisters 1002 successively receive the liquid crystal display data of a next line. Further, the liquid crystal drive voltage corresponding to the liquid crystal display data of one frame can be formed by repeating the operation during one frame period.

The brightness (or light transmittance) displayed on the liquid crystal panel is determined by a difference between the counter electrode voltage (Vcom) applied on the counter electrode and the drain voltage (Vd) applied on the pixel electrode. The sign (+/−) of the difference has nothing to do with the light transmittance. Therefore, as has been previously described, in this embodiment, the negative drain voltage (Vd) is applied on the drain line at a column on which the high level counter electrode voltage (VcomH) is applied. The positive drain voltage (Vd) is applied on the drain line on which the low level counter electrode voltage (VcomL) is applied. Therefore, the digital/analog conversion circuit 1004 and the digital/analog conversion circuit 1005 always output the drain voltages having mutually different polarities even if the display data is a data showing the same display color.

Since the present embodiment has a structure in which the pixel electrodes 703 and the counter electrodes 120 and 121 are provided at either of the two sheets of the glass substrates 401 and 402 constituting the liquid crystal panel, it is therefore not necessary to prescribe accurately the distance between the glass substrate 401 and the glass substrate 402. This feature enables an improvement in yield in the manufacturing steps. Further, an orientation film is not necessary at the glass substrate 401, thereby enabling a reduction in the manufacturing cost of the liquid crystal panel.

In the described embodiment, the twist angle (direction) of the liquid crystal molecules 801 is changed in a plane in parallel with the panel face of the liquid crystal panel. Accordingly, the viewing angle is very wide and the image can be optically recognized in viewing the panel from an oblique angle.

Not only the drain voltage Vd, but also the counter electrode voltage vcom use the high level/low level values by which the amplitude of the drain voltage (Vd) necessary for applying an alternating current voltage on the liquid crystals 118 can be reduced. Accordingly, the voltage resistance capability required for the signal drivers 1001 is sufficient for a voltage value of approximately 5 V and the signal drivers can be manufactured by using a generally used LSI process, thereby enabling a reduction in cost.

The number of pixels in a general display is fewer in the column direction than in the row direction. Therefore, by installing the counter electrodes 120 or 121 in the column direction, current flowing in a single counter electrode 120 or 121 can be reduced. Accordingly, a distortion of voltage can be reduced and image quality can be improved.

In the described embodiment, the change of the counter electrode voltage (Vcom) accompanied by the driving by alternating current may be performed with respect to every one frame period and the frequency is low. Therefore, flicker can be reduced more than in a conventional liquid crystal panel. For example, considering a case of N=480, the frequency of the alternating current driving is 70 Hz. In the conventional liquid crystal panel in which the counter electrodes are arranged in the row direction, the change of the counter electrode voltage accompanied by the alternating current driving must be performed with respect to every line period and the frequency is high. For example, in case of N=480, it is approximately 33 kHz (=1/(70×80)).

Figure 7:
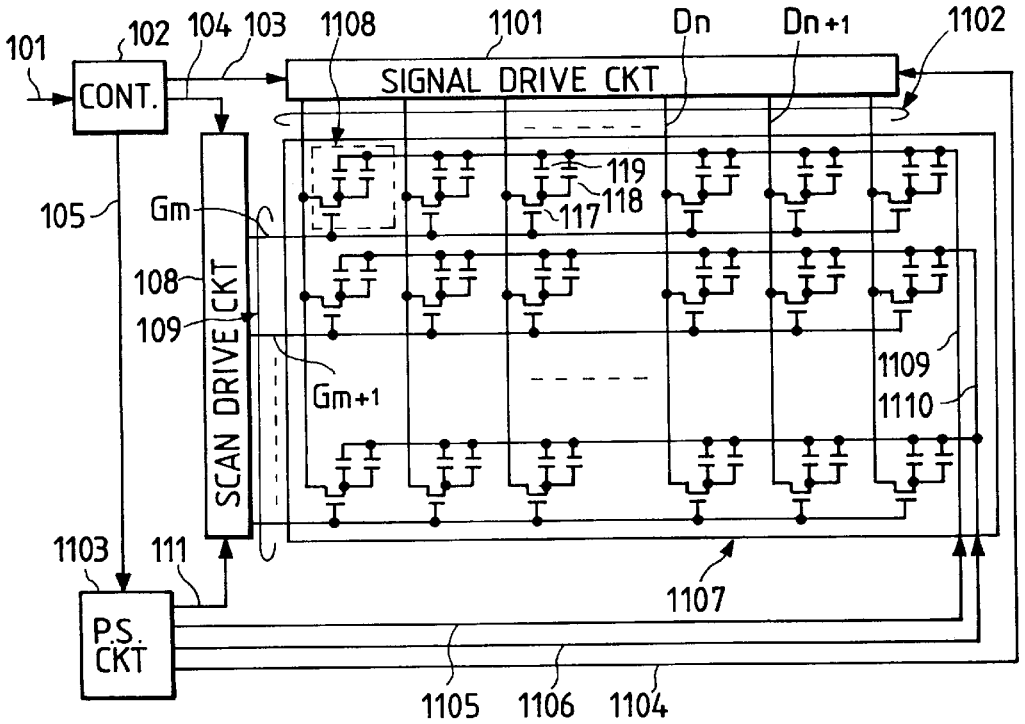
FIG. 7 shows primarily in block diagram a TFT liquid crystal display device according to another embodiment of the present invention.

Another embodiment of liquid crystal display device in accordance with the present invention is described with reference to FIG. 7–FIG. 11, wherein FIG. 7 shows the liquid crystal display device as being constituted by the liquid crystal controller 102, a signal drive circuit 1101, the scan drive circuit 108, a power source circuit 1103 and a TFT liquid crystal panel 1107. Further, the device includes the signal bus 101, the signal buses 103 and 104, a drain bus 1102, the gate bus 109 and the power source buses 111, 1104 and 1105 and 1106.

The TFT liquid crystal panel 1107 is constituted by the drain bus 1102 including N drain lines D and the gate bus 109 including M gate lines G intersected to each other in a matrix form. Further, pixels 1108 are formed at the respective intersection points. Accordingly, the TFT liquid crystal panel 1107 of this example has N×M pixels 1108. The gate line at the m-th row is designated by "Gm," a gate line at m+1-th row is designated by "Gm+1," a drain line at the n-th column is designated by "Dn" and a drain line at n+1-th is designated by "Dn+1." The pixel 1108 is provided with the liquid crystal 118 and the auxiliary capacitor 119. Further, the pixel is provided with the TFT 117, the pixel electrode 703, a counter electrode 1109 or 1110 and the auxiliary capacitor electrode 704. In FIG. 7 the liquid crystal is equivalently represented as the capacitor 118.

The orientation state of the liquid crystal molecules is maintained by storing an electric charge in the liquid crystal 118 and the auxiliary capacitor 119 in the TFT liquid crystal panel 1107. The TFT 117 is a switch for controlling charge/discharge of the electric charge to and from the liquid crystal 118 and the auxiliary capacitor 119. The application of voltage on the liquid crystal 118 is provided by a difference between potentials of the pixel electrode 703 and the counter electrode 1109 or 1110. The auxiliary capacitor 119 is provided for reducing leakage current from the liquid crystal 118. The application of voltage on the auxiliary capacitor 119 is provided by a difference between potentials of the auxiliary capacitor electrode 704 and the pixel electrode 703. The auxiliary capacitor electrode 704 and the counter electrode 1109 or 1110 are in a conductive state and its potential is equal to the potential of the corresponding counter electrode 1109 or 1110.

In this embodiment, the counter electrodes 1109 and 1110 are arranged in the row direction. Further, the counter electrodes 1109 are connected to the pixels 1108 at an odd number row and the counter electrodes 1110 are connected to the pixels 1108 at even number rows. Thereby, in the liquid crystal panel 1107 the counter electrode voltages (Vcom), as described later, are classified as the pixels 1108 belonging to odd number rows and the pixels 1108 belonging to even number rows which can be controlled independently from each other. Further, as shown in FIG. 8, in the liquid crystal panel 1107, both of the pixel electrodes 703 and the counter electrodes 1109 and 1110 are arranged on the side of the glass substrate 402.

The liquid crystal controller 102 converts display data and synchronizing signals supplied from a system (not shown) via the signal bus 101 in compliance with the signal drive circuit 1101 and the scan drive circuit 108. The liquid crystal controller 102 outputs liquid crystal display data and liquid crystal drive signals after conversion to the signal drive circuit 1101 via the signal bus 103. Further, predetermined liquid crystal drive signals are similarly outputted to the scan drive circuit 108 via the signal bus 104. The signal drive circuit 1101 outputs drain voltages (Vd) in correspondence with the display data inputted from the liquid crystal controller 102 to the pixel electrodes 703 of the liquid crystal panel via drain lines D from the drain bus 1102 and the TFTs 117. The scan drive circuit 108 applies gate voltages (Vg) determined in accordance with signals inputted from the liquid crystal controller 102 on the gate electrodes of the TFTs 117 via the gate lines G. The gate voltages (Vg) are outputted for successively selecting the pixels of one horizontal line.

The power source circuit 1103 supplies the above-described various portions with various voltages necessary for driving the liquid crystal panel display. The power source circuit 1103 supplies the power source voltages to the scan drive circuit 108 via the power source bus 111 and to the signal drive circuit 107 via the power source bus 1104. Further, the power source circuit 1103 supplies the counter electrodes 1109 and 1110 with counter electrode voltages. In this embodiment, the counter electrode voltages are classified and supplied to the counter electrodes 1109 at odd number rows and the counter electrodes 1110 at even number rows. That is, a counter electrode voltage (VcomOG) is outputted to the counter electrodes 1109 via the power source bus 1105 and a counter electrode voltage (VcomEG) is outputted to the counter electrodes 1110 via the power source bus 1106. An auxiliary capacitor voltage (Vstg) is outputted to the auxiliary capacitor electrodes 704 via the power source buses 1105 and 1106.

Figure 8:
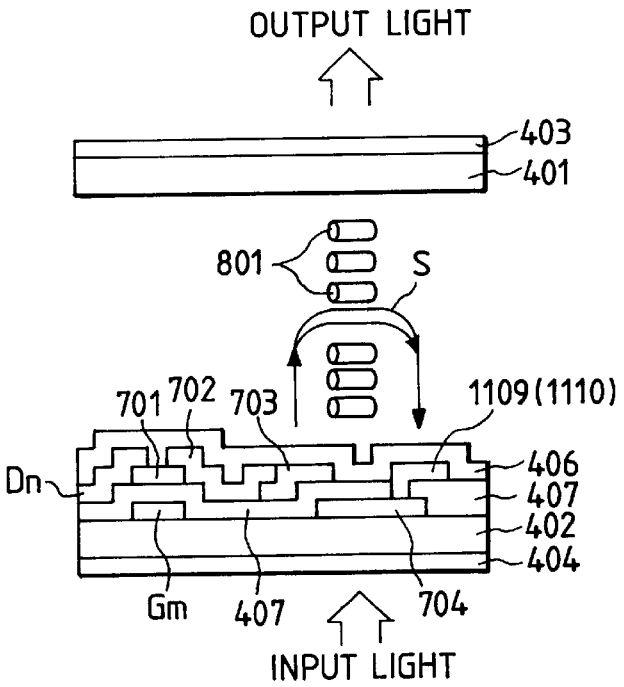
FIG. 8 is a schematic view showing the internal structure of a liquid crystal panel of FIG. 7.

As shown in FIG. 8 the liquid crystal panel 1107 is constituted by the glass substrates 401 and 402, the polarizing films 403 and 404, the orientation film 406, the insulating film 407 and the liquid crystal molecules 801. Further, the panel includes the TFTs 117, the gate lines G, the drain lines D, the counter electrodes 1109 and 1110, the auxiliary capacitor electrodes 704 and the pixel electrodes 703. The glass substrate 401 and the glass substrate 402 oppose each other in parallel maintaining a predetermined distance with the liquid crystal molecules 801 being filled therebetween. The liquid crystal molecules 801 are the same as those in the embodiment of FIG. 1.

Figure 9:
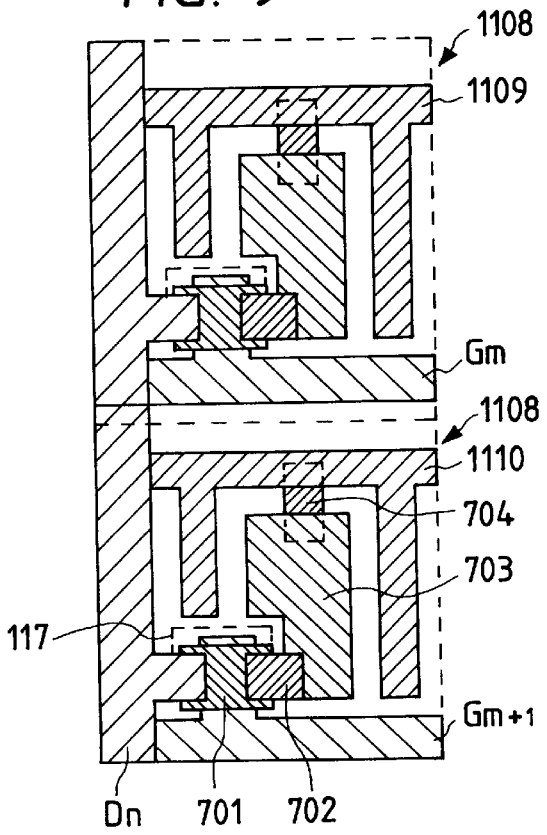
FIG. 9 is an enlarged plane view of a pixel of FIG. 7.

The TFTs 117 are provided at the glass substrate 402. As shown in FIG. 9, the TFT 117 is constituted by the silicon portion 701, a gate electrode, a drain electrode and the source electrode 702 connected to the pixel electrode 703. Actually, the gate electrode is constituted by a gate line G and the drain electrode is constituted by a drain line D. Further, the insulating film 407 between the pixel electrode 703 and the auxiliary capacitor electrode 704 operates as the auxiliary capacitor 119. Additionally, as shown in FIG. 8, the counter electrodes 1109 and 1110 are installed on the side of the glass substrate 402, that is, on the side of the pixel electrodes 703.

The liquid crystal panel 1107 of this embodiment is of a transmitting type. Therefore, portions in the above-described members in which the light transmittance cannot be changed by the twist angle of the liquid crystal molecules 801 (that is, portions wherein the potential gradient in a direction in parallel with the liquid crystal panel face is not present) must be opaque. However, portions in which the light transmittance can be changed by the twist angle (direction) of the liquid crystal molecules 801 must be transparent. More specifically, a region in which the light transmittance can be changed is a region between the pixel electrode 703 and the counter electrode 1109 or 1110 in each pixel. Accordingly, in this embodiment the insulating films 407, the auxiliary capacitor electrodes 704 and the orientation films 406 are made transparent. On the other hand, the drain lines D, the gate lines G, the silicon portions 701, the source electrodes 702, the pixel electrodes 703 and the counter electrodes 1109 and 1110 are made opaque. However, with regard to the portions to be opaque, all the portions enumerated here may not be opaque. With regard to the thickness direction of the liquid crystal panel, it is sufficient that the portions are opaque when viewing the entire liquid crystal panel. The polarizing plates 403 and 404 are semitransparent. In a liquid crystal panel of a reflection type to which the present invention is applicable, the counter electrodes 1109 and 1110, the pixel electrodes 703 and the like may be transparent.

Figure 10A:
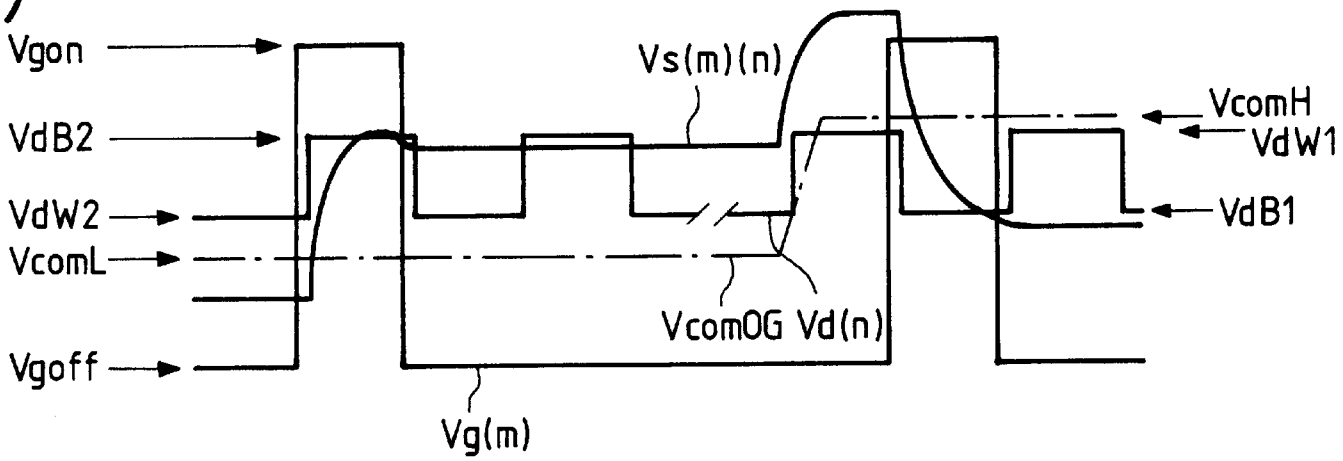
FIGS. 10(*a*) and 10(*b*) show drive waveforms of the liquid crystal display device of FIG. 7.
Figure 10B:
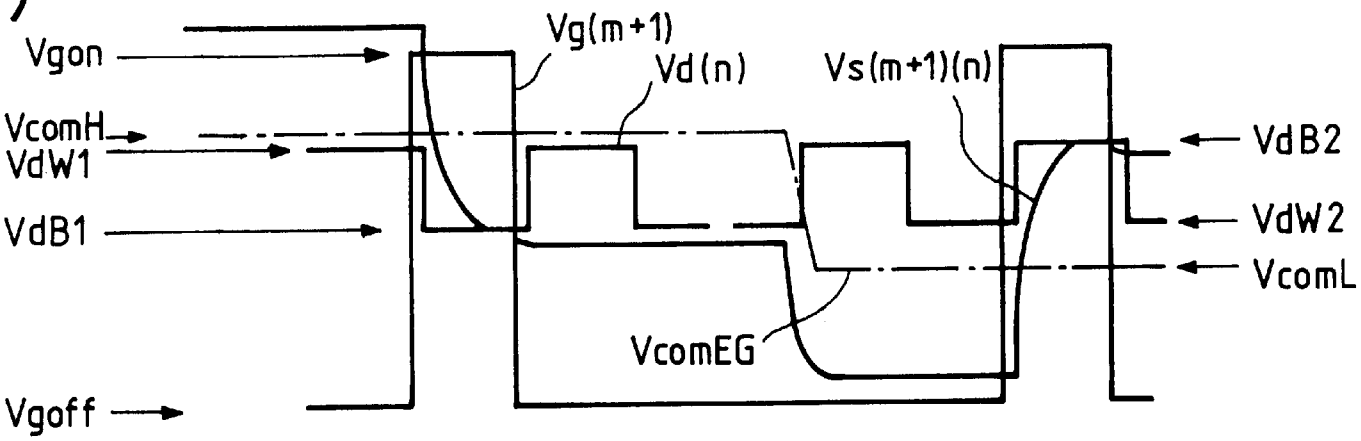

The display operation of the liquid crystal panel 1107 is described with reference to FIGS. 10(*a*) and 10(*b*) which show drive voltage waveforms in one frame period in a case where the counter electrode voltage (Vcom)=auxiliary capacitor electrode voltage (Vstg)=reference voltage (Vcen) and the following notations are utilized:

Vg(m): Voltage waveform applied on gate line Gm;

Vd(n): Voltage waveform applied on drain line Dn;

Vd(n+1): Voltage waveform applied on drain line Dn+1;

Vs(m)(n): Waveform of a pixel voltage (hereinafter, "source voltage") applied on the liquid crystal 118 of a pixel at the m-th row, n-th column; Vs(m)(n+1): Waveform of a pixel voltage (hereinafter, "source voltage") applied on the liquid crystal 118 of a pixel at the m-th row, n-th column;

VcomOD: Voltage waveform of the counter electrode at the odd number column;

VcomEG: Voltage waveform of the counter electrode at the even number column;

VcomH: High level counter electrode voltage; and

VcomL: Low level counter electrode voltage.

The liquid crystal controller 102 converts display data and synchronizing signals transmitted through the signal bus 101 into liquid crystal data and liquid crystal drive signals for driving the TFT liquid crystal panel 1107. Further, the liquid crystal controller supplies the liquid crystal drive signals etc. to the signal drive circuit 1101 respectively via the signal bus 103 and also supplies the appropriate signals to the scan drive circuit 108 via the signal bus 104. Further, the liquid crystal controller supplies predetermined signals to the power source circuit 110 via the signal bus 105.

The signal drive circuit 1101 successively receives liquid crystal display data sent via the signal bus 103. When the signal drive circuit 1101 has finished receiving the liquid crystal display data of one horizontal line, the signal drive circuit 1101 simultaneously outputs the drain voltages (Vd) corresponding to the received liquid crystal display data to the drain bus 107 in synchronism with similarly sent synchronizing signals. The signal drive circuit 1101 continues outputting the drain voltage during one horizontal period. In parallel with outputting of the drain voltages (Vd) the signal drive circuit 1101 successively receives liquid crystal display data of a next line. The signal drive circuit 1101 form the drain voltages in correspondence with the liquid crystal display data of one frame by repeating this operation during one frame period.

In the liquid crystal panel 1107 the twist angle of the liquid crystal molecules 801 present at each pixel portion, that is, the transmittance of the pixel is changed by controlling the electric field at each pixel 1108. In this embodiment, both of the counter electrodes 1109 and 1110 and the pixel electrodes 703 are on the side of the glass substrate 402. In this embodiment as in the previous embodiment, there are portions wherein the gradient of the electric field driving the liquid crystal molecules 801 is in a direction in parallel with the liquid crystal panel (void portion of an arrow mark S in FIG. 8). The electric field is controlled by controlling a voltage difference (source voltage) between the drain voltage applied on the pixel electrode 703 and the voltage applied on the counter electrode 1109 or 1110. In a case where the applied voltage difference is large, the transmittance is lowered and the pixel becomes dark. However, in a case where the applied voltage difference is small, the transmittance is enhanced and the pixel becomes bright.

The application of the drain voltage Vd on the pixel electrode 703 is effected by successively applying a select voltage (Vgon) on the gate line G of the gate bus 109 by the scan drive circuit 108 in synchronism with outputting the drain voltage Vd to the drain bus 107 by the signal drive circuit 1101. When an ON voltage (Vgon) is applied on the gate line Gm, the drain voltages Vd(n) and Vd(n+1) applied on the drain lines Dn and Dn+1, are supplied to the pixel electrode 703 of the pixel 1108 at m-th row via the TFTs 117. Further, differences between the drain voltages (Vd(n), Vd(n+1)) applied at this time and the counter electrode voltage (Vcom) become the source voltages (Vs(m)(n), Vs(m)(n+1)) at this time. An electric charge of an amount corresponding to the source voltages (Vs(m)(n), Vs(m)(n+1)) is stored in the liquid crystal (capacitor) 118 and the auxiliary capacitor 119.

In this embodiment, an alternating current is formed by switching the voltage level of the counter electrode voltage Vcom between the high level (VcomH) and the low level (VcomL) frame by frame. The voltage level of the counter electrode 120 at an odd number column and the voltage level of the counter electrode 121 at an even number column are controlled independently from each other. That is, when the voltage level of the counter electrode voltage VcomOD at an odd number column is at a low level (VcomL), the voltage level of the counter electrode voltage VcomED at an even number column is made at a high level (VcomH). Conversely, when the voltage level of the counter electrode voltage VcomOD at the odd number column is at the high level (VcomH), the voltage level of the counter electrode voltage VcomED at the even number column is made at the low level (VcomL). Such a control of the counter voltages is performed by the power source circuit 1103.

Further, the signal drive circuit 1101 alternately applies the positive drain voltage and the negative drain voltage row by row. The negative drain voltage Vd is outputted when a row on which the high level counter electrode voltage (VcomH) is applied is selected. The positive drain voltage Vd is outputted when a row on which the low level counter electrode voltage (VcomL) is applied is selected. The "positive drain voltage" corresponds to a drain voltage having the voltage level higher than the low level counter electrode voltage VcomL. The "negative drain voltage" corresponds to the drain voltage having the voltage level lower than the high level counter electrode voltage (VcomH). Thereby, with regard to one pixel 1108 the positive voltage and the negative voltage can alternately be applied frame by frame. Therefore, the deterioration of the liquid crystal 118 can be prevented. Further, in view of the entirety of the screen, the polarity of voltage applied on the pixels 1108 is reversed at every row even during one frame. Accordingly, the polarity of the applied voltage becomes uniform with respect to the entirety of the screen and high voltage display without flicker can be achieved.

Figure 11:
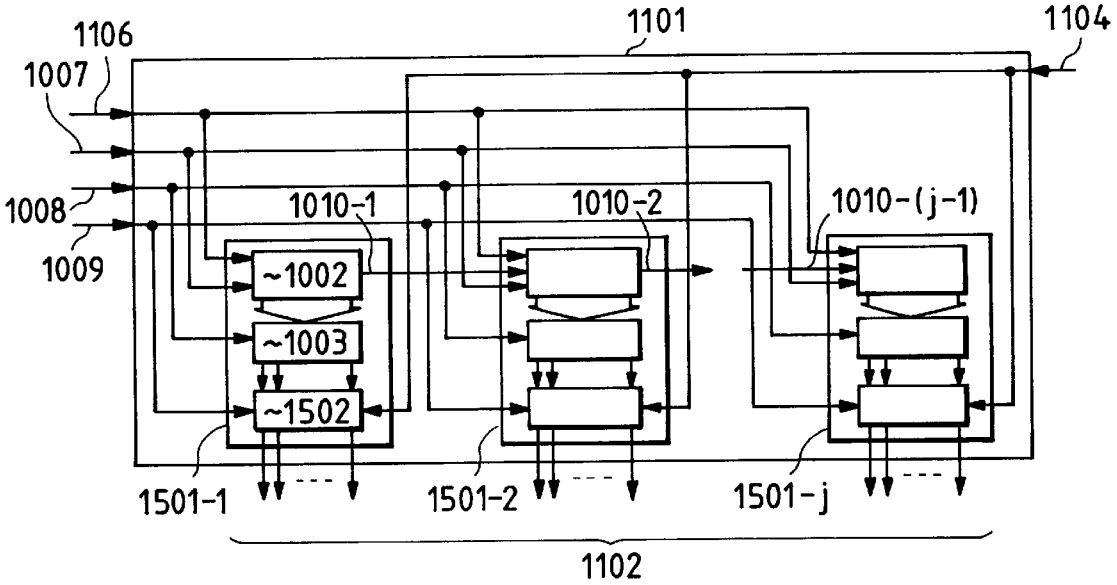
FIG. 11 is a block diagram showing the internal structure of a signal drive circuit of FIG. 7.

As shown in FIG. 11 the signal drive circuit 1101 includes a plurality of signal drivers 1501 and signal lines 1006, 1007, 1008, 1009 and 1010 for supplying the various signal drivers with various signals. A J-th signal driver among the signal drivers 1501 is particularly designated as "signal driver 1501-j." The signal driver 1501 is constituted by a shift resistor 1002, a latch circuit 1003 and a digital/analog conversion circuit 1502. The data bus or signal line 1006 is provided for supplying display data sent from the liquid crystal controller 102 to the shift resister 1002. The signal line 1007 is provided for supplying data shift clocks sent from the liquid crystal controller 102 to the shift resister 1002. The signal line 1008 is provided for supplying data latch clocks sent from the liquid crystal controller 102 to the latch circuit 1003. The signal line 1009 is provided for supplying liquid crystal alternating current forming signals sent from the liquid crystal controller 102 to the digital/analog conversion circuit 1502. Each of the bus 1006, the signal lines 1007, 1008 and 1009 is included in the signal bus 103 of FIG. 7. The signal line 1010 is provided for sending enable signals for controlling the operational timings among the respective signal drivers 1501. The enable signal of each signal driver 1501 is outputted to the signal driver 1501 located contiguously on the right in the figure. The signal driver 1501 operates in the following manner. When an enable signal 1010 becomes effective, the shift resister 1002 successively receives a liquid crystal display data 1006 in synchronism with a data shift clock 1007. A data latch clock 1008 becomes effective when the liquid crystal display data of one horizontal line has been received by the shift resisters 1002 of all the signal drivers (1501-1 through 1501-j). Thereby the liquid crystal display data of one horizontal line is latched by the latch circuits 1003 of the signal drivers 1501-1 to 1501-j.

The digital/analog conversion circuit 1502 converts the liquid crystal display data into a liquid crystal drive voltage (drain voltage) and continues outputting the liquid crystal drive voltage via the drain bus 1102 during one horizontal period. In the meantime, the shift resister 1002 successively receives the liquid crystal display data of a next line. Further, the liquid crystal drive voltage corresponding to the liquid crystal display data of one frame can be formed by repeating the operation during one frame period.

The signal drive circuit 1101 alternately outputs the negative drain voltage (Vd) and the positive drain voltage row by row. The signal drive circuit 1501 outputs the negative drain voltage in a case where the high level counter electrode voltage (VcomH) is applied on the row selected at that time, that is, the row on which the ON voltage (Vgon) is applied. Meanwhile, the signal drive circuit 1501 outputs the positive drain voltage in a case where the row level counter electrode voltage (VcomL) is applied on the row selected at that time. Accordingly, the digital/analog conversion circuit 1502 outputs the drain voltages having different polarities row by row even if the display data is a data showing the same display color.

The above description is directed to a structure in which the pixel electrodes 703 and the counter electrodes 1109 and 1110 are provided at either of the two sheets of the glass substrates 401 and 402 constituting the liquid crystal panel. Therefore, it is not necessary to prescribe accurately the distance between the glass substrate 401 and the glass substrate 402. This actually amounts to an improvement in yield in the manufacturing steps. Further, an orientation film is not necessary at the glass substrate 401 and enables a reduction in the manufacturing cost of the liquid crystal panel.

In this embodiment the twist angle of the liquid crystal molecules 801 is changed in a plane in parallel with the panel face of the liquid crystal panel. Accordingly, the viewing angle is very wide and the image can be optically recognized in viewing the panel from an oblique angle.

By combining the control of the counter electrode voltages (high level/low level) with the control of the drain voltages the amplitude of the drain voltages necessary for applying an alternating current voltage on the liquid crystals 118 can be reduced. Accordingly, the voltage resistance capability required for the signal drivers 1501 is sufficient for a voltage value of approximately 5 V and the signal drivers can be manufactured by using a generally used LSI process which enables a reduction in cost.

Figure 12:
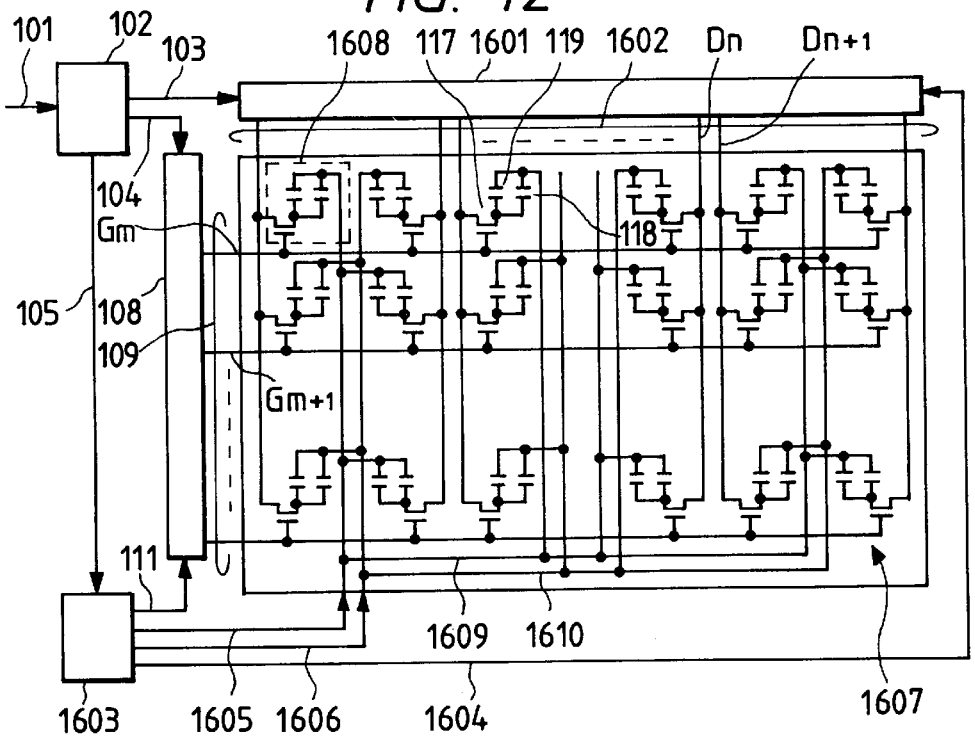
FIG. 12 shows primarily in block diagram a TFT liquid crystal display device according to a further embodiment of the present invention.

A further embodiment of a liquid crystal display device of the present invention is described with reference to FIG. 12–FIG. 15. As shown in FIG. 12, the liquid crystal display device of this embodiment is constituted by the liquid crystal controller 102, a signal drive circuit 1601, the scan drive circuit 108, a power source circuit 1603 and a TFT liquid crystal panel 1607. Further, the device includes the signal bus 101, the signal buses 103, 104 and 105, a drain bus 1602, the gate bus 109 and the power source buses 111, 1604 and 1605 and 1606 for sending and receiving various signals, voltages and the like among the respective portions (or to and from the outside)

The TFT liquid crystal panel 1607 is constituted by the drain bus 1602 including N drain lines D and the gate bus 109 including M gate lines G intersected to each other in a matrix form. Further, pixels 1608 are formed at the respective intersection points. Accordingly, the TFT liquid crystal panel 1607 of this example has N×M pixels 1608. The gate line at m-th row is designated by "Gm," a gate line at the m+1-th row is designated by "Gm+1," a drain line at the n-th column is designated by "Dn" and a drain line at the n+1-th column is designated by "Dn+1."

The pixel 1608 is provided with the liquid crystal 118 and the auxiliary capacitor 119. Further, the pixel is provided with the TFT 117, the pixel electrode 703, a counter electrode 1609 or 1610 and the auxiliary electrode 704. In FIG. 12, the liquid crystal 118 is equivalently represented as the capacitor 118. The orientation state of the liquid crystal molecules is maintained by storing an electric charge in the liquid crystal 118 and the auxiliary capacitor 119 in the TFT liquid crystal panel 1607. The TFT 117 is a switch for controlling the charge/discharge of the electric charge to and from the liquid crystal 118 and the auxiliary capacitor 119. The application of voltage on the liquid crystal 118 is effected by a difference between potentials of the pixel electrode 703 and the counter electrode 1609 or 1610. The auxiliary capacitor 119 is provided for reducing leakage current from the liquid crystal 118. The application of voltage on the auxiliary capacitor 119 is effected by a difference between potentials of the auxiliary capacitor electrode 704 and the pixel electrode 703. The auxiliary capacitor electrode 704 and the counter electrode 1609 or 1610 are in a conductive state and its potential is equal to the potential of the corresponding counter electrode 1609 or 1610.

In this embodiment the counter electrodes 1609 and 1610 are arranged in the row direction. Further, the counter electrode 1609 is connected to the pixels 1608 at odd number rows and odd number columns and to the pixels 1608 at even number rows and even number columns. Meanwhile, the counter electrode 1610 is connected to the pixels 1608 at odd number rows and even number columns and to the pixels 1608 at even number rows and odd number columns. Thereby, in the liquid crystal panel 1607, the counter electrode voltages (Vcom), as described later, are classified as two groups of the pixels (group ①: the pixels 1608 at odd number rows and odd number columns and the pixels 1608 at even number rows and even number columns, group ②: the pixels 1608 at odd number rows and even number columns and the pixels 1608 at even number columns and odd number columns) which can be controlled independently from each other. In the liquid crystal panel 1607 of this embodiment, as shown in FIG. 13, both of the pixel electrodes 703 and the counter electrodes 1609 and 1610 are arranged on the side of the glass substrate 402.

The liquid crystal controller 102 converts display data and synchronizing signals supplied from a system (not shown) via the signal bus 101 in compliance with the signal drive circuit 1601 and the scan drive circuit 108. The liquid crystal controller 102 outputs liquid crystal display data and liquid crystal drive signals after conversion to the signal drive circuit 1601 via the signal bus 103. Further, predetermined liquid crystal drive signals are similarly outputted to the scan drive circuit 108 via the signal bus 104. The signal drive circuit 1601 outputs drain voltages (Vd) in correspondence with the display data inputted from the liquid crystal controller 102 to the pixel electrodes 703 of the liquid crystal panel via drain lines D and the TFTs 117. The scan drive circuit 108 applies gate voltages (Vg) determined in accordance with signals inputted from the liquid crystal controller 102 on the gate electrodes of the TFTs 117 via the gate lines G. The gate voltages (Vg) are outputted for successively selecting the pixels of one horizontal line.

The power source circuit 1603 supplies the above-described various portions with various voltages necessary for driving the liquid crystal panel display. The power source circuit 1603 supplies the voltages to the scan drive circuit 108 via the power source bus 111 and to the signal drive circuit 107 via the power source bus 1604. Further, the power source circuit 1603 supplies the counter electrodes 1609 and 1610 with voltages. In this embodiment, the voltages are classified and supplied to the counter electrodes 1609 and the counter electrodes 1610. That is, the power source circuit 1603 supplies a counter electrode voltage (Vcom1) to the counter electrodes 1609 (that is, of the pixels 1608 at the odd number rows and odd number columns and the pixels 1608 at the even number rows and even number columns) via the power source bus 1605. The circuit supplies a counter electrode voltage (Vcom2) to the counter electrodes 1610 (that is, of the pixels 1608 at odd number rows and even number columns and the pixels 1608 at even number rows and odd number columns) via the power source bus 1606. An auxiliary capacitor voltage (Vstg) is outputted to the auxiliary capacitor electrodes 704, as shown in FIG. 13 and FIG. 14, also via the power source buses 1605 and 1606.

Figure 13:
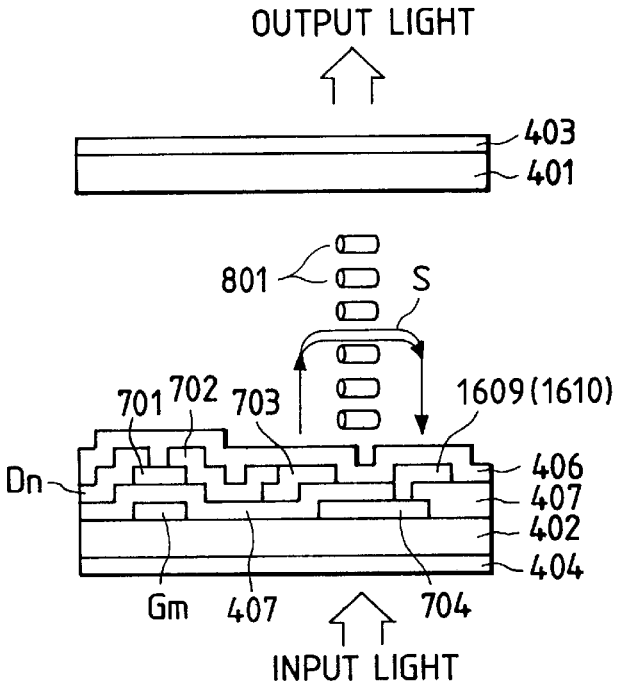
FIG. 13 is a schematic view showing the internal structure of a liquid crystal panel of FIG. 12.
Figure 14:
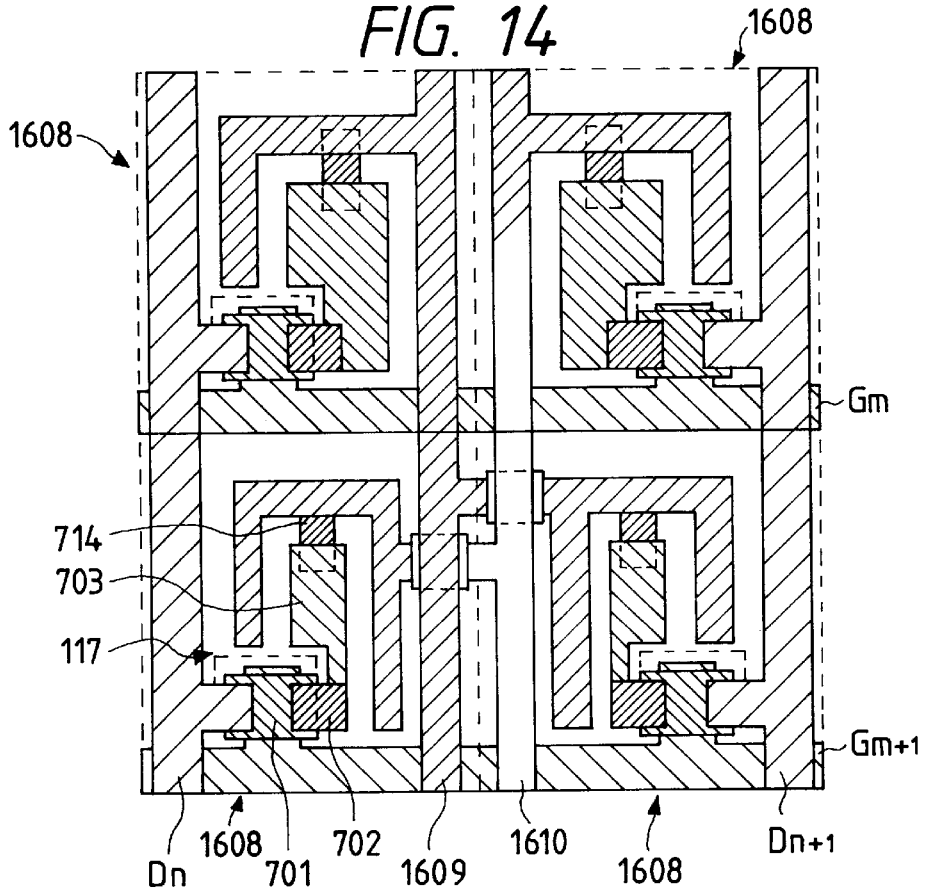
FIG. 14 is an enlarged plane view of a pixel of FIG. 12.

As shown in FIG. 13, the liquid crystal panel 1607 is constituted by the glass substrates 401 and 402, the polarizing films 403 and 404, the orientation film 406, the insulating film 407 and the liquid crystal molecules 801. Further, the panel includes the TFTs 117, the gate lines G, the drain lines D, the counter electrodes 1609 and 1610, the auxiliary capacitor electrodes 704 and the pixel electrodes 703. The glass substrate 401 and the glass substrate 402 oppose each other in parallel maintaining a predetermined distance with the liquid crystal molecules 801 being filled therebetween. The liquid crystal molecules 801 are the same as those in the embodiment of FIG. 1.

The TFTs 117 are provided at the glass substrate 402. As shown in FIG. 13 and FIG. 14 the TFT 117 is constituted by the silicon portion 701, a gate electrode, a drain electrode and the source electrode 702 connected to the pixel electrode 703. Actually, the gate electrode is constituted by a gate line G and the drain electrode is constituted by a drain line D. Further, the insulating film 407 put between the pixel electrode 703 and the auxiliary capacitor electrode 704 operates as the above-described auxiliary capacitor 119. Further, as shown in FIG. 13, the counter electrodes 1609 and 1610 are installed on the side of the glass plate 402, that is, on the side of the pixel electrodes 703. The direction of the electric field caused between the counter electrode 1609 or 1610 and the pixel electrode 704 corresponding thereto, is designated by an arrow mark S in FIG. 13. As shown in FIG. 13, there is a portion in the direction of the electric field which is in parallel with the panel face (the glass substrate face) and the portion of the electric field in parallel with the panel face is designated by the void in the arrow mark S.

As a result of adopting the above-described panel structure (that is, the structure wherein the counter electrodes and the pixel electrodes are provided on the same side) and the liquid crystals 801, the twist angle of the liquid crystal molecules 801 changes only in a plane in parallel with the panel face in accordance with the strength of applied voltage. Further, the liquid crystal molecules 801 are oriented such that their long axes are positioned in a plane in parallel with the panel face by their own property even if there is no orientation film.

The liquid crystal panel 1607 of this embodiment is of a transmitting type. Therefore, portions in the above-described members in which the light transmittance cannot be changed by the twist angle of the liquid crystal molecules 801 (that is, portions wherein the potential gradient in a direction in parallel with the liquid crystal panel face is not present) must be opaque. On the other hand, portions in which the light transmittance can be changed by the twist angle (direction) of the liquid crystal molecules 801 must be transparent. More specifically, a region in which the light transmittance can be changed is a region between the pixel electrode 703 and the counter electrode 1609 or 1610 in each pixel. Accordingly, in this embodiment, the insulating films 407, the auxiliary capacitor electrodes 704 and the orientation films 406 are made transparent. Meanwhile, the drain lines D, the gate lines G, the silicon portions 701, the source electrodes 702, the pixel electrodes 703 and the counter electrodes 1609 and 1610 are made opaque. However, with regard to the portions to be opaque, all the portions enumerated here may not be opaque. With regard to the thickness direction of the liquid crystal panel, it is sufficient that the portions are opaque in view of the entirety of the liquid crystal panel. The polarizing plates 403 and 404 are semi-transparent. In a liquid crystal panel of a reflection type to which the present invention is applicable, the counter electrodes 1609 and 1610, the pixel electrodes 703 and the like may be transparent.

Figure 15A:
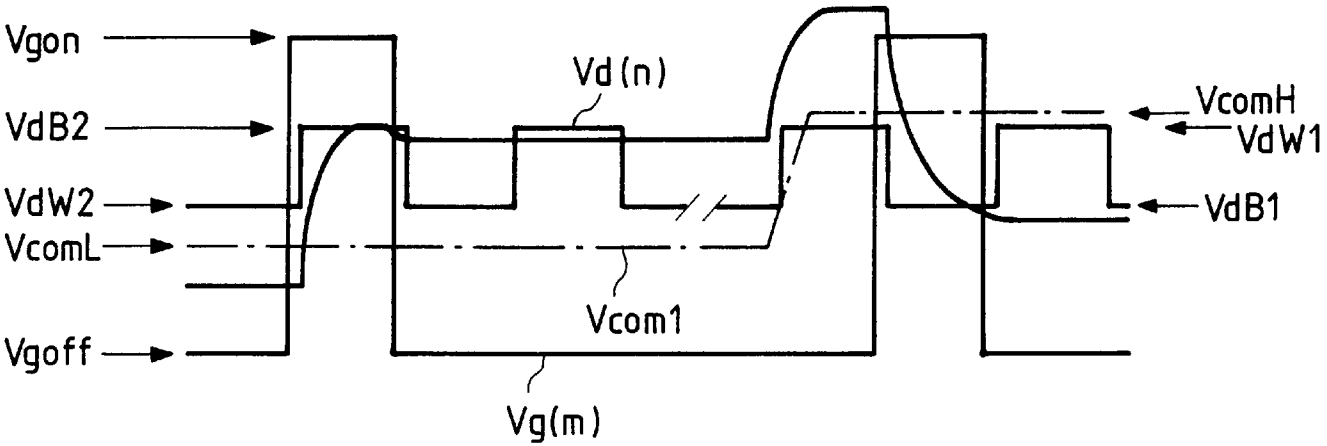
FIGS. 15(*a*) and 15(*b*) show drive waveforms of the liquid crystal display device of FIG. 12.
Figure 15B:
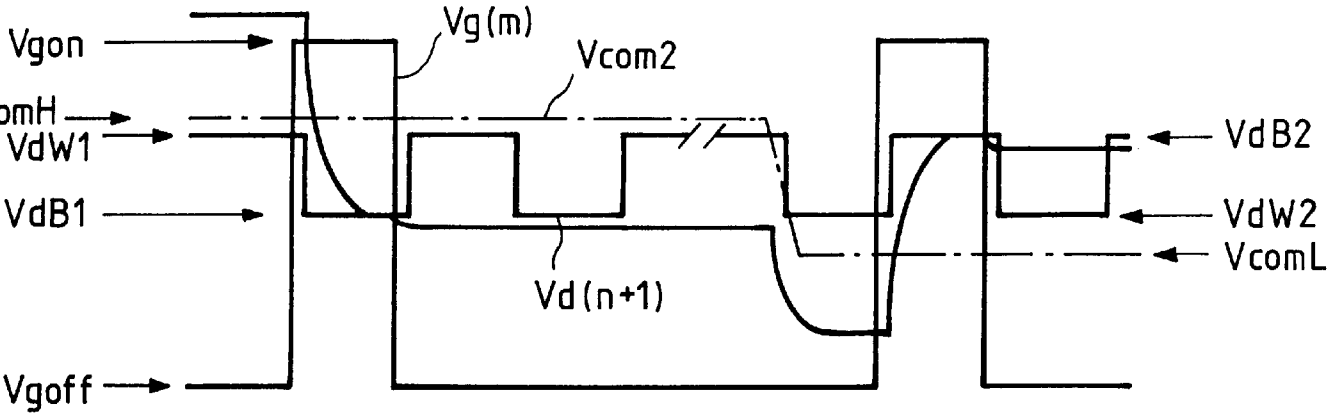

The display operation of the liquid crystal panel 1607, is described with reference to FIGS. 15(*a*) and 15(*b*), which show drive voltage waveforms in one frame period in a case where the counter electrode voltage (Vcom)=auxiliary capacitor electrode voltage (vstg)=reference voltage (Vcen). and the following designations are utilized.

Vg(m): Voltage waveform applied on gate line Gm;

V(n): Voltage waveform applied on drain line Dn;

Vs(m)(n): Waveform of a pixel voltage (hereinafter, "source voltage") applied on the liquid crystal 118 of a pixel at the m-th row, n-th column;

Vcom1: Voltage waveform of the counter electrode at a pixel at an odd number row and odd number column or at an even number row and even number column;

Vcom2: Voltage waveform of the counter electrode at a pixel at an odd number row and even number column or at an even number row and odd number column;

VcomH: High level counter electrode voltage; and

VcomL: Low level counter electrode voltage.

The liquid crystal controller 102 converts display data and synchronizing signals transmitted through the signal bus 101 into liquid crystal data and liquid crystal drive signals for driving the TFT liquid crystal panel 1607. Further, the liquid crystal controller supplies the liquid crystal drive signals etc. to the signal drive circuit 1601 respectively via the signal bus 103 and supplies the appropriate signals to the scan drive circuit 108 via the signal bus 104. Further, the controller supplies predetermined signals to the power source circuit 1603 via the signal bus 105. The signal drive circuit 1601 is similar to the signal drive circuit 1001 of FIG. 6, but with the polarities of the outputted drain voltages being reversed row by row in the signal drive circuit 1001.

In the liquid crystal panel 1607 the twist angle of the liquid crystal molecules 801 present at each pixel portion, that is, the transmittance of the pixel is changed by controlling the electric field at each pixel. In this embodiment, both of the counter electrodes 1609 and 1610 and the pixel electrodes 703 are on the side of the glass substrate 402. Accordingly, the electric field driving the liquid crystal molecules 801 is in parallel with the liquid crystal panel. The electric field is controlled by controlling a voltage difference (source voltage) between the drain voltage applied on the pixel electrode 703 and the voltage applied on the counter electrode 1609 or 1610. In a case where the applied voltage difference is large, the transmittance is lowered and the pixel becomes dark. However, in a case where the applied voltage difference is small, the transmittance is enhanced and the pixel becomes bright.

The application of the drain voltage Vd on the pixel electrode 703 is effected by successively applying a select voltage (Vgon) on the gate line G of the gate bus 109 by the scan drive circuit 108 in synchronism with outputting the drain voltage Vd to the drain bus 1602 by the signal drive circuit 1601. When an ON voltage (Vgon) is applied on the gate line Gm, the drain voltages Vd(n) and Vd(n+1) supplied via the drain lines Dn and Dn+1, are applied on the pixel electrode 703 of the pixel 703 at the m-th row via the TFTs 117. Further, differences between the drain voltages (Vd(n), Vd(n+1)) applied at this time and the counter electrode voltage (Vcom) become the source voltages (Vs(m)(n), Vs(m)(n+1)) at this time. An electric charge of an amount corresponding to the source voltages (Vs(m)(n), Vs(m)(n+1)) is stored in the liquid crystal (capacitor) 118 and the auxiliary capacitor 119.

In this embodiment, an alternating current is formed by switching the voltage level of the counter electrode voltage Vcom between the high level (VcomH) and the low level (VcomL) frame by frame. The voltage level (Vcom1) of the counter electrode 1609 and the voltage level (Vcom2) of the counter electrode 1601 are controlled independently from each other. That is, when the voltage level of the counter electrode voltage Vcom1 is at a low level (VcomL), the voltage level of the counter electrode voltage Vcom2 is made at a high level (VcomH). Conversely, when the voltage level of the counter electrode voltage Vcom1 is at the high level (VcomH), the voltage level of the counter electrode voltage Vcom2 is made at the low level (VcomL).

Further, the polarity (positive/negative) of the drain voltage Vd is also changed in accordance with such a control of the counter electrode voltage (Vcom). That is, with respect to the row selected at that time, the negative drain voltage Vd is supplied on the drain line D corresponding to the pixels on which the high level counter electrode voltage (VcomH) is applied. Meanwhile, the positive drain voltage Vd is applied on the drain corresponding to the pixels on which the low level counter electrode voltage (VcomL) is applied. The "positive drain voltage" here is a drain voltage having a voltage level higher than the low level counter electrode voltage (VcomL). The "negative drain voltage" is a drain voltage having a voltage level lower than the high level counter electrode voltage (VcomH).

The control of the drain voltage in accordance with this embodiment is performed independently with respect to the drain lines D connected to the pixels 1608 of the group ① and those connected to the pixels 1608 of the group ②. Accordingly, for example, when the positive drain voltage (VdB2) is outputted to the drain line Dn of the group ①, the negative drain voltage (VdB1) is outputted to the drain bus D(n+1) of the group ②. Thereby, with respect to a certain pixel 1608 the positive voltage and the negative voltage are applied thereon alternately frame by frame. Accordingly, the deterioration of the liquid crystals 118 can be prevented. Further, in viewing the entire screen or panel the polarities of the voltages applied on the respective pixels 1608 are reversed column by column and row by row even in one frame period. Therefore, the polarities of the applied voltages are made uniform with regard to the total of the screen and high image quality display without flicker can be achieved. The present embodiment provides effects similar to that of the embodiment of FIG. 1 with generation of flicker and the like being further reduced and the display quality being enhanced as compared with those in the embodiment of FIG. 1, since the polarities of the applied voltages are changed column by column.

Another embodiment of the present invention provides that the counter electrodes and the pixel electrodes are arranged on the same glass substrate side and the counter electrodes of all the pixels are made common. Such embodiment of a liquid crystal display device is described with reference to FIG. 16–FIG. 20.

Figure 16:
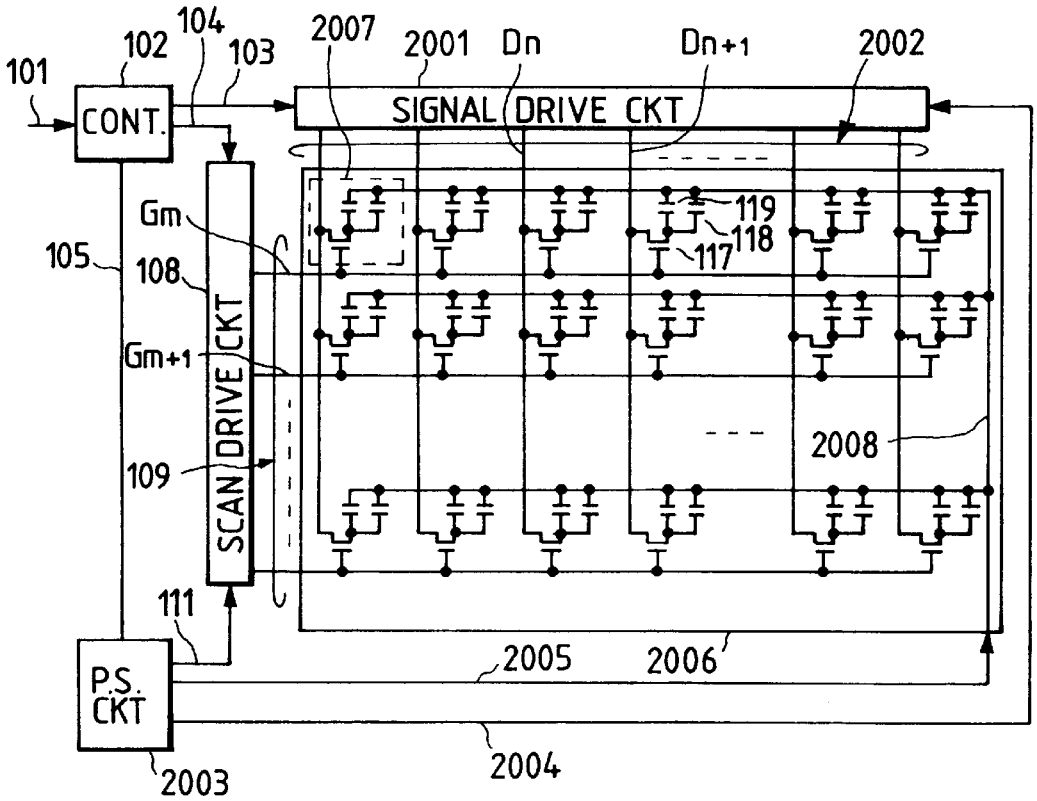
FIG. 16 shows primarily in block diagram a TFT liquid crystal display device according to a further embodiment of the present invention.

As shown in FIG. 16, the liquid crystal display device of this embodiment is constituted by the liquid crystal controller 102, a signal drive circuit 2001, the scan drive circuit 108, a power source circuit 2003 and a TFT liquid crystal panel 2006. Further, the device includes the signal bus 101, the signal buses 103, 104 and 105, a drain bus 2002, the gate bus 109 and the power source buses 111, 2004 and 2005 for sending and receiving various signals, voltages and the like among the respective portions (or to and from the outside).

The TFT liquid crystal panel 2006 is constituted by the drain bus 2002 including N drain lines D and the gate bus 109 including M gate lines G intersected to each other in a matrix form. Further, pixels 2007 are formed at the respective intersection points. Accordingly, the TFT liquid crystal panel 2006 of this example has N×M of the pixels 2007. The gate line at the m-th row is designated by "Gm," a gate line at the m+1-th row is designated by "Gm+1," a drain line at the n-th column is designated by "Dn" and a drain line at the n+1-th is designated by "Dn+1."

Figure 17:
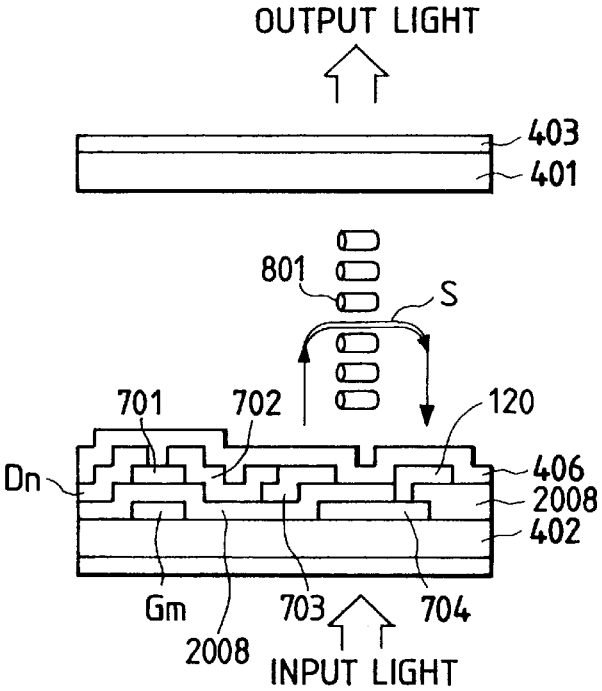
FIG. 17 is a schematic view showing the internal structure of a liquid crystal panel of FIG. 16.
Figure 18:
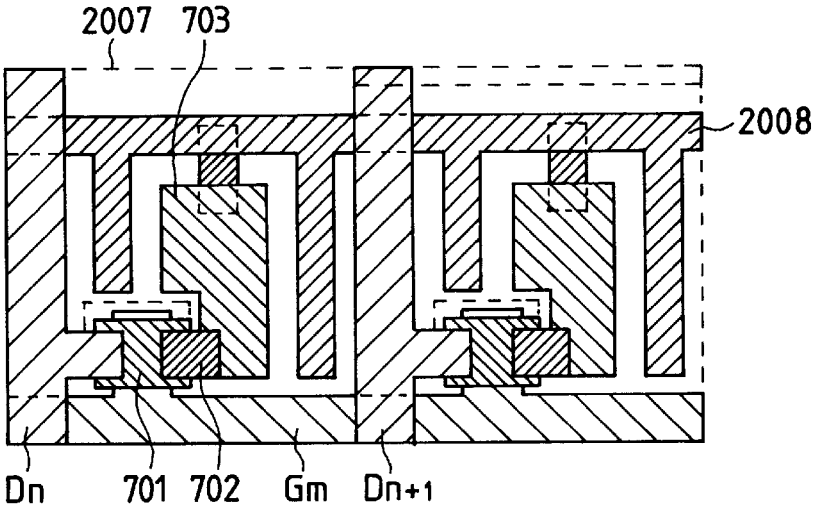
FIG. 18 is an enlarged plane view of a pixel of FIG. 16.

The pixel 2007 is provided with the liquid crystal 118 and the auxiliary capacitor 119. Further, the pixel is provided with the TFT 117, the pixel electrode 703, a counter electrode 2008 and the auxiliary electrode 704 as shown in FIG. 17 and FIG. 18. In FIG. 17, the liquid crystal is equivalently represented as the capacitor 118. The orientation state of the liquid crystal molecules is maintained by storing an electric charge in the liquid crystal 118 and the auxiliary capacitor 119 in the TFT liquid crystal panel 2006. The TFT 117 is a switch for controlling the charge/discharge of the electric charge to and from the liquid crystal 118 and the auxiliary capacitor 119.

The application of voltage on the liquid crystal 118 is effected by a difference between potentials of the pixel electrode 703 and the counter electrode 2008. The auxiliary capacitor 119 is provided for reducing leakage current from the liquid crystal 118. The application of voltage on the auxiliary capacitor 119 is effected by a difference between potentials of the auxiliary capacitor electrode 704 and the pixel electrode 703. The auxiliary capacitor electrode 704 and the counter electrode 2008 are in a conductive state. Therefore, its potential is equal to the potential of the corresponding counter electrode 2008.

In this embodiment, the counter electrodes 2008 are arranged in the row direction. Counter electrode voltages are supplied to all the counter electrodes via the power source bus 2005. That is, the counter electrode voltages are controlled summerizingly with respect to all the pixels 2007. Further, in the liquid crystal panel 2006, both of the pixel electrodes 703 and the counter electrodes 2008 are arranged on the side of the glass substrate 402 as shown in FIG. 17.

The liquid crystal controller 102 converts display data and synchronizing signals supplied from a system (not shown) via the signal bus 101 in compliance with the signal drive circuit 2001 and the scan drive circuit 108. The liquid crystal controller 102 outputs liquid crystal display data and liquid crystal drive signals after conversion to the signal drive circuit 2001 via the signal bus 103. Further, predetermined liquid crystal drive signals are similarly outputted to the scan drive circuit 108 via the signal bus 104. The signal drive circuit 2001 outputs drain voltages (Vd) in correspondence with the display data inputted from the liquid crystal controller 102 to the pixel electrodes 703 of the liquid crystal panel via drain lines D and the TFTs 117. The scan drive circuit 108 applies gate voltages (Vg) determined in accordance with signals inputted from the liquid crystal controller 102 on the gate electrodes of the TFTs 117 via the gate lines G. The gate voltages (Vg) are outputted for successively selecting the pixels of one horizontal line.

The power source circuit 2003 supplies the above-described various portions with various voltages necessary for driving the liquid crystal panel display. The power source circuit 2003 also supplies the power source voltages to the scan drive circuit 108 via the power source bus 111 and to the signal drive circuit 2001 via the power source bus 2004. Further, the power source circuit 2003 supplies the counter electrodes 2008 with counter electrode voltages (VcomOD) via the power source bus 2005. The supply of auxiliary capacitor voltages (Vstg) to the auxiliary capacitor electrodes 704, as shown in FIG. 17, is effected also through the power source bus 2005.

As shown in FIG. 17, the liquid crystal panel 2006 is constituted by the glass substrates 401 and 402 the polarizing films 403 and 404, the orientation film 406, the insulating film 407 and the liquid crystal molecules 801. Further, the panel includes the TFTs 117, the gate lines G, the drain lines D, the counter electrodes 2008, the auxiliary capacitor electrodes 704 and the pixel electrodes 703. The glass substrate 401 and the glass substrate 402 oppose each other in parallel maintaining a predetermined distance and the liquid crystal molecules 801 are filled therebetween. The liquid crystal molecules 801 are the same as those in the embodiment of FIG. 1.

The TFTs 117 are provided at the glass substrate 402. As shown in FIG. 18, the TFT 117 is constituted by the silicon portion 701, a gate electrode, a drain electrode and the source electrode 702 connected to the pixel electrode 703. Actually, the gate electrode is constituted by a gate line G and the drain electrode is constituted by a drain line D. Further, the insulating film 407 put between the pixel electrode 703 and the auxiliary capacitor electrode 704 operates as the above-mentioned auxiliary capacitor 119. Further, in this embodiment, the counter electrodes 2008 are installed on the side of the glass substrate 402, that is, on the side of the pixel electrodes 703 as shown in FIG. 17.

The direction of electric field generated between the counter electrode 2008 and the pixel electrode 703 corresponding thereto is shown by an arrow mark S in FIG. 17.

As shown in FIG. 17, there is a portion of the direction of the electric field which is in parallel with the panel face (glass substrate face) and the arrow mark S is indicated with a void with regard to the portion of the electric field in parallel with the panel face. By providing the above-described panel structure (that is, a structure in which the counter electrodes and the pixel electrodes are arranged on the same side) and the liquid crystals 801, in the liquid crystal panel of this embodiment the twist angle of the liquid crystal molecules 801 is changed only in a plane in parallel with the panel face in accordance with the strength of the applied voltage.

The liquid crystal panel 2006 of this embodiment is of a transmitting type. Therefore, portions in the above-described members in which the light transmittance cannot be changed by the twist angle of the liquid crystal molecules 801 (that is, portions wherein the potential gradient in a direction in parallel with the liquid crystal panel face is not present) must be opaque. On the other hand, portions in which the light transmittance can be changed by the twist angle (direction) of the liquid crystal molecules 801 must be transparent. More specifically, a region in which the light transmittance can be changed is a region between the pixel electrode 703 and the counter electrode 2008 in each pixel. Accordingly, in this embodiment, the insulating films 407, the auxiliary capacitor electrodes 704 and the orientation films 406 are made transparent. The drain lines D, the gate lines G, the silicon portions 701, the source electrodes 702, the pixel electrodes 703 and the counter electrodes 2008 are made opaque. However, with regard to the portions to be opaque, all the portions enumerated here may not be opaque. With regard to the thickness direction of the liquid crystal panel, it is sufficient that the portions are opaque in view of the entirety of the liquid crystal panel. The polarizing plates 403 and 404 are semitransparent. In a liquid crystal panel of a reflection type to which the present invention is applicable, the counter electrodes 2008, the pixel electrodes 703 and the like may be transparent.

Figure 19A:
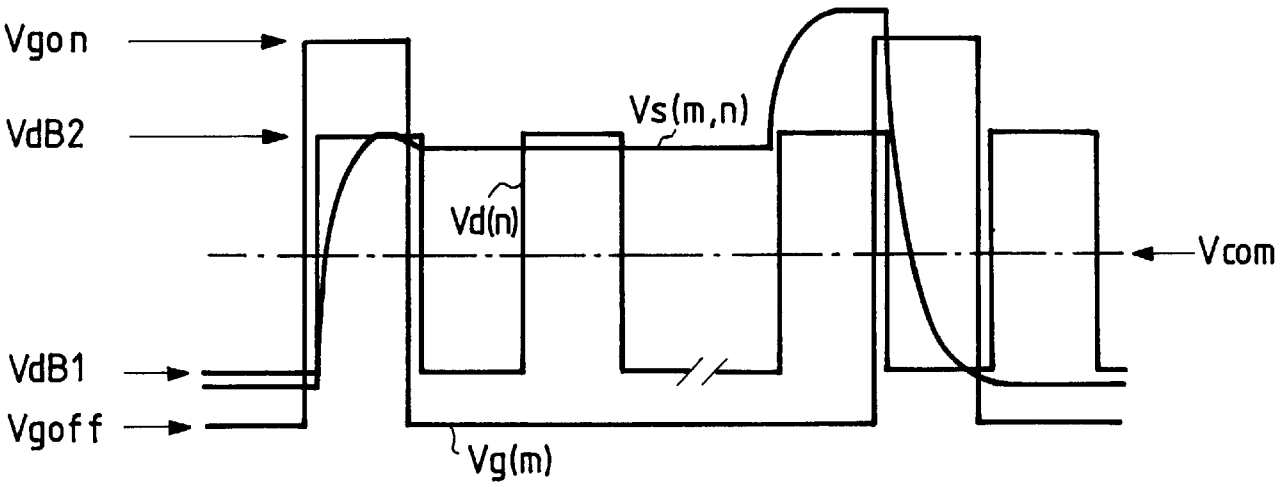
FIGS. 19(*a*) and 19(*b*) show drive waveforms of the liquid crystal display device of FIG. 16.
Figure 19B:
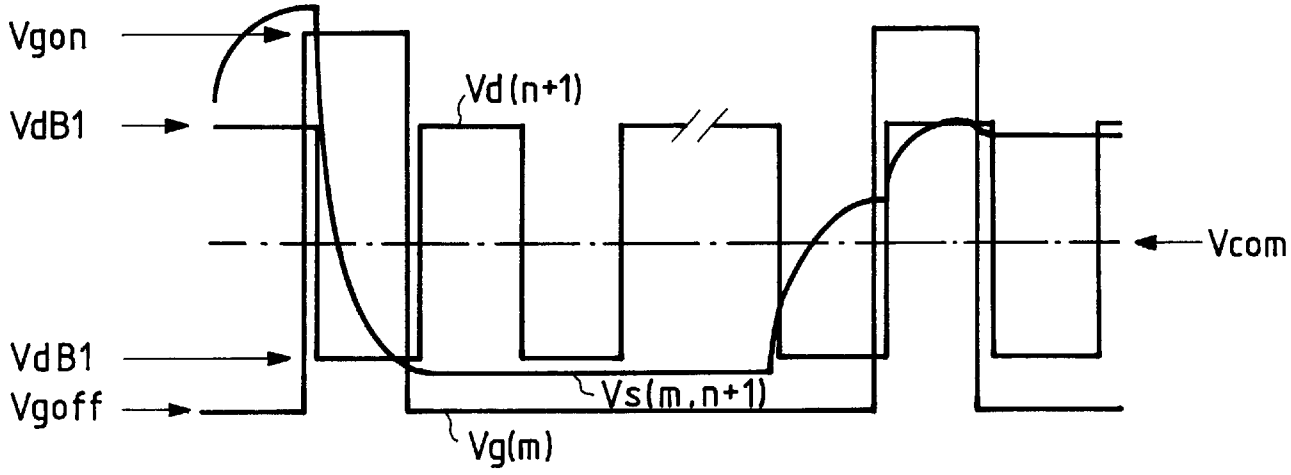
Figure 21:
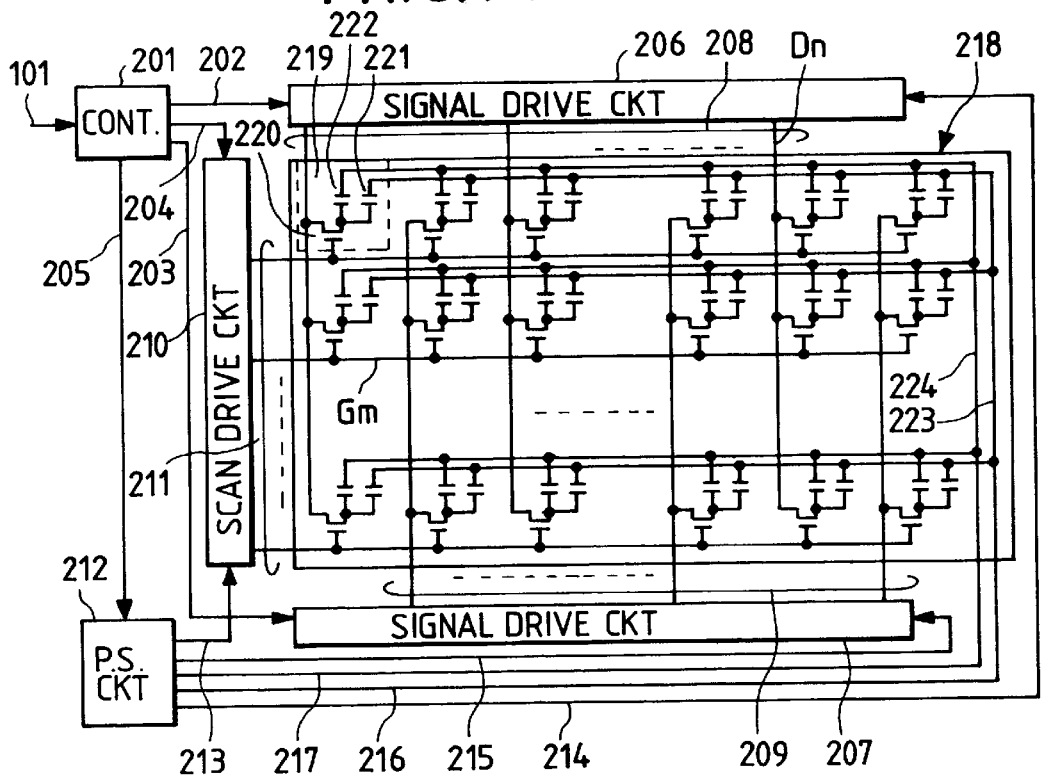
FIG. 21 PRIOR ART
FIG. 21 shows primarily in block diagram a conventional TFT liquid crystal display device.

The display operation of the liquid crystal panel 2006 is described with reference to FIGS. 19(*a*) and 19(*b*) which show drive voltage waveforms in one frame period in a case where the counter electrode voltage (Vcom)=auxiliary capacitor electrode voltage (Vstg)=reference voltage (Vcen) and indicate the following notations are utilized.

Vg(m): Voltage waveform applied on gate line Gm;

Vd(n): Voltage waveform applied on drain line Dn;

Vd(n+1): Voltage waveform applied on drain line Dn+1;

Vs(m)(n): Waveform of a pixel voltage (hereinafter, "source voltage") applied on the liquid crystal 118 of a pixel at the m-th row, n-th column;

Vcom: Voltage waveform of the counter electrode;

VcomH: High level counter electrode voltage; and

VcomL: Low level counter electrode voltage.

The liquid crystal controller 102 converts display data and synchronizing signals transmitted through the signal bus 101 into liquid crystal data and liquid crystal drive signals for driving the TFT liquid crystal panel 2006. Further, the liquid crystal controller supplies the liquid crystal drive signals etc. to the signal drive circuit 2001 respectively via the signal bus 103 and it supplies the appropriate signals to the scan drive circuit 108 via the signal bus 104. Further, the controller supplies predetermined signals to the power source circuit 2003 via the signal bus 105. The signal drive circuit 2001 successively receives liquid crystal display data sent via the signal bus 103. When the signal drive circuit 2001 has finished receiving the liquid crystal display data of one horizontal line, the signal drive circuit 2001 simultaneously outputs the drain voltages (Vd) corresponding to the received liquid crystal display data to the drain bus 2002 in synchronism with similarly sent synchronizing signals. The signal drive circuit 2001 continues outputting the drain voltage during one horizontal period. In parallel with outputting of the drain voltages (Vd) the signal drive circuit 2001 successively receives liquid crystal display data of a next line. The signal drive circuit 2001 forms the drain voltages in correspondence with the liquid crystal display data of one frame by repeating this operation during one frame period.

In the liquid crystal panel 2006, the twist angle of the liquid crystal molecules 801 present at each pixel portion, that is, the transmittance of the pixel is changed by controlling the electric field at each pixel. In this embodiment, both of the counter electrodes 2008 and the pixel electrodes 703 are on the side of the glass substrate 402. Accordingly, the electric field driving the liquid crystal molecules 801 is in parallel with the liquid crystal panel which is quite different from the conventional liquid crystal panel. The electric field is controlled by controlling a voltage difference (source voltage, potential difference) between the drain voltage applied on the pixel electrode 703 and the voltage applied on the counter electrode 2008. In a case where the applied voltage difference (source voltage) is large, the transmittance is lowered and the pixel becomes dark. However, in a case where the applied voltage difference (source voltage) is small, the transmittance is enhanced and the pixel becomes bright.

The application of the drain voltage Vd on the pixel electrode 703 is effected by successively applying a select voltage (Vgon) on the gate line G of the gate bus 109 by the scan drive circuit 108 in synchronism with outputting the drain voltage Vd to the drain bus 2002 by the signal drive circuit 2001. When an ON voltage (Vgon) is applied on the gate line Gm, the drain voltages Vd(n) and Vd(n+1) applied on the drain lines Dn and Dn+1, are applied on the pixel electrode 703 at m-th row via the TFTs 117. Further, differences between the drain voltages (Vd(n), Vd(n+1)) applied at this time and the counter electrode voltage (Vcom) become the source voltages (Vs(m)(n), Vs(m)(n+1)) at this time. Electric charge having an amount corresponding to the source voltages (Vs(m)(n), Vs(m)(n+1)) is stored in the liquid crystal (capacitor) 118 and the auxiliary capacitor 119. In this embodiment, the voltage level of the counter electrode voltage Vcom stays constant.

The polarity (positive/negative) of the drain voltage Vd is changed row by row and frame by frame. That is, in one frame the drain voltage Vd (n) is made positive and the drain voltage Vd (n+1) is made negative. In the next frame, the drain voltage Vd (n) is made negative and the drain voltage Vd (n+1) is made positive. The "positive drain voltage" is a drain voltage having the voltage level higher than the counter electrode voltage (Vcom). The "negative drain voltage" is a drain voltage having the voltage level lower than the high level counter electrode voltage (Vcom). By controlling the level of the drain voltage in this way with regard to a single pixel 2007, the positive and the negative voltages are alternately applied frame by frame. Accordingly, the deterioration of the liquid crystals 118 can be prevented. Further, in viewing the entirety of the screen, the voltages applied on the pixels 2007 are reversed row by row even in one frame. Accordingly, the polarities of the applied voltages are made uniform in view of the total of the screen, flickers are prevented from being generated and a high image quality display can be achieved.

Figure 20:
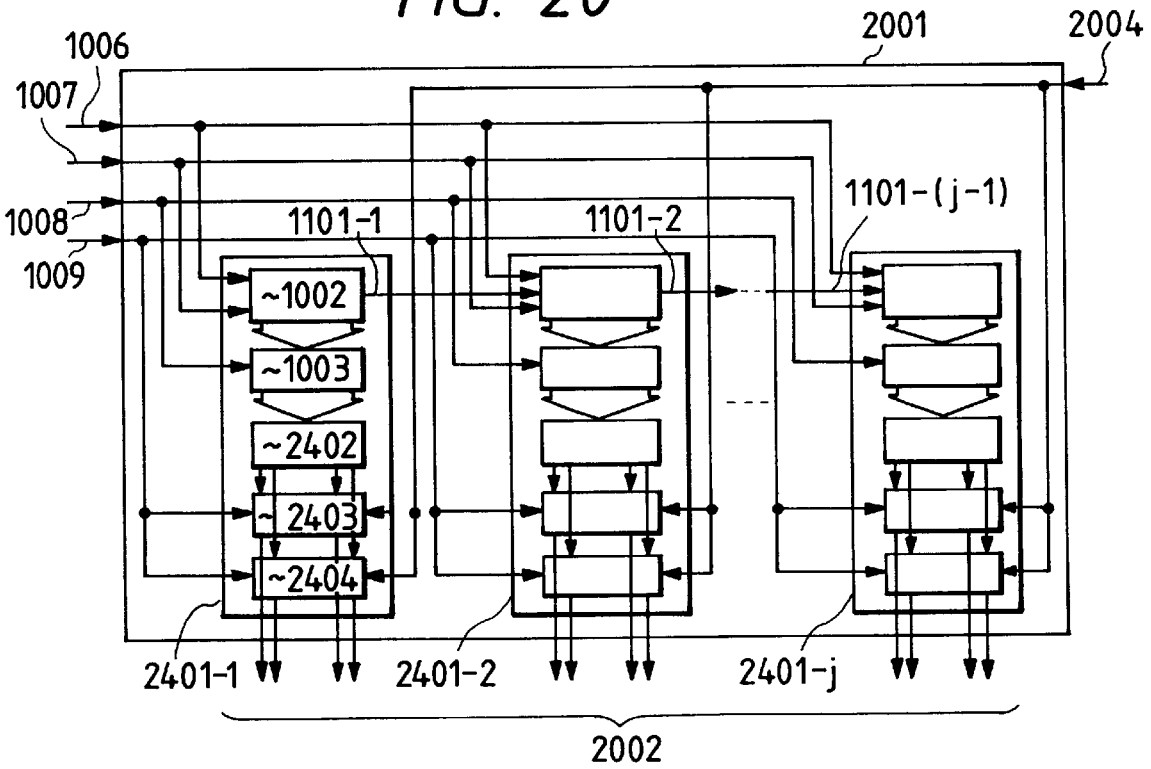
FIG. 20 is a block diagram showing the internal structure of a signal drive circuit of FIG. 16.

The signal drive circuit 2001 is described with reference to FIG. 19 and FIG. 20. As shown in FIG. 20 the signal drive circuit 2001 includes a plurality of signal drivers 2401 and signal lines 1006, 1007, 1008, 1009 and 1101 for supplying the various signal drivers with various signals. A J-th signal driver among the signal drivers 2401 is particularly designated as "signal driver 2401-j." The signal driver 2401 is constituted by a shift resistor 1002, a latch circuit 1003, a level shifter circuit 2402 and digital/analog conversion circuits 2403 and 2404. The level shifter circuits 2402 are provided to change the voltage level of the display data with respect to every drain line D and frame by frame. The change of the voltage level is performed with a purpose of changing the polarities of the drain voltages Vd.

The digital/analog conversion circuits 2403 and 2404 convert the voltage levels outputted by the level shifter circuits into liquid crystal drive voltages (drain voltage) and output them to the drain bus 2002. The digital/analog conversion circuits 2403 are connected to the drain lines Dn at odd number orders in the drain bus 2002 and the digital/analog conversion circuits 2404 are connected the drain lines Dn+1 at even number orders. The data bus 1006 is provided for supplying display data sent from the liquid crystal controller 102 to the shift resister 1002. The signal line 1007 is provided for supplying data shift clocks sent from the liquid crystal controller 102 to the shift resister 1002. The signal line 1008 is provided for supplying data latch clocks sent from the liquid crystal controller 102 to the latch circuit 1003. The signal line 1009 is provided for supplying liquid crystal alternating current forming signals sent from the liquid crystal controller 102 to the digital/analog conversion circuits 2403 and 2404. Each of the bus 1006, the signal lines 1007, 1008 and 1009 is included in the signal bus 103. The signal line 1101 is provided for sending enable signals for controlling the operational timings among the respective signal drivers 2401. The enable signal of each signal driver 2401 is outputted to the signal driver 2401 located contiguously on the right in the figure.

In the operation of the signal driver 2401, when an enable signal 1101 becomes effective, the shift resister 1002 successively receives a liquid crystal display data 1006 in synchronism with a data shift clock 1007. A data latch clock 1008 becomes effective when the liquid crystal display data of one horizontal line has been received by the shift resisters 1002 of all the signal drivers (2401-1 through 2401-j). Thereby the liquid crystal display data of one horizontal line is latched by the latch circuits 1003 of the signal drivers 2401-1 to 2401-j. The level shifter circuits 2402 convert the voltage level of the display data and output it. The digital/analog conversion circuits 2403 and 2404 convert data outputted by the level shifter circuits 2402 into liquid crystal drive voltages (drain voltages) and continue outputting the liquid crystal drive voltages (drain voltages) via the drain bus 2002 during one horizontal period. In the meantime, the shift resisters 1002 successively receive the liquid crystal display data of a next line. Further, the liquid crystal drive voltage corresponding to the liquid crystal display data of one frame can be formed by repeating the operation during one frame period.

The brightness (or light transmittance) displayed in the liquid crystal panel is determined by the difference between the counter electrode voltage (Vcom) applied on the counter electrode and the drain voltage (Vd) applied on the pixel electrode. The sign (+/−) of the difference have nothing to do with the light transmittance. Therefore, in this embodiment, the polarities of the drain voltages (Vd) are reversed row by row. Accordingly, the digital/analog conversion circuit 2403 and the digital/analog conversion circuit 2404 always output the drain voltages having different polarities even if the display data is a data showing the same display color.

In this embodiment, the pixel electrodes 703 and the counter electrodes 2008 are provided on either of the two sheets of the glass substrates 401 and 402 constituting the liquid crystal panel. Therefore, it is not necessary to accurately prescribe the distance between the glass substrate 401 and the glass substrate 402 and enables an improvement in yield in the manufacturing steps. Further, the orientation film is not necessary for the glass substrate 401 enabling a reduction in the manufacturing cost of the liquid crystal panel.

The voltages of the counter electrodes of all the pixels are summerizingly controlled and the voltage levels are made constant and therefore, simplification of the liquid crystal panels and circuits can be archived. For example, simplification of power source circuits and the reduction of buses supplying voltages to the counter electrodes are made possible.

According to the TFT liquid crystal display device of the embodiment of FIG. 1, the positive and negative liquid crystal drive voltages can be applied on the pixels column by column. Therefore, the polarities of the applied voltages are made uniform in view of the entirety of the screen, flickers are prevented from generating and high image quality display can be achieved. Further, the signal drivers constituting the signal drive circuit can be constituted by a generally used logic process and therefore, a low cost thereof can be achieved. Additionally, an alternating current is applied on the counter electrodes frame by frame and therefore, the embodiment has the effect of low power consumption.

According to the TFT liquid crystal display device of the embodiment of FIG. 7, the positive and negative liquid crystal drive voltages can be applied on the pixels row by row. Therefore, the polarities of the applied voltages are made uniform in view of the entirety of the screen, flickers are prevented from generating and high image quality display can be achieved. Further, as in embodiment of FIG. 1, the signal drivers constituting the signal drive circuit can be constituted by a generally used logic process and therefore, the low cost thereof can be achieved and such embodiment has the effect of low power consumption since an alternating current is applied on the counter electrodes frame by frame.

According to the TFT liquid crystal display device of the embodiment of FIG. 12, the positive and the negative liquid crystal drive voltage can be applied on the pixels row by row and column by column. Therefore, the polarities of the applied voltages are made uniform in view of the entirety of the screen, flickers are prevented from generating and high image quality display can be achieved. Further, as in the embodiment of FIG. 1, the signal drivers constituting the signal drive circuit can be constituted by a generally used logic process and therefore, the low cost thereof can be achieved and the example has the effect of low power consumption since an alternating current is applied on the counter electrodes frame by frame.

The liquid crystal display device of the embodiment of FIG. 16 also achieves high image quality and low production cost.

As described above according to the present invention a liquid crystal display device which is manufactured at low cost, which is operated with low power consumption and which has high image quality can be provided.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A liquid crystal panel comprising:

a transparent first substrate;

a second substrate arranged so as to oppose the first substrate with a space therebetween;

liquid crystals in the space between the first substrate and the second substrate and having a twist angle which changes in a plane in parallel with a direction of an electric field;

pixels including thin film transistors (TFT), each TFT having a gate electrode, a drain electrode and a source electrode, the pixels further including pixel electrodes connected to the source electrodes, counter electrodes, the pixels being arranged in M rows and N columns, where M and N are integers of at least two, both of the pixel electrodes and the counter electrodes being provided at the second substrate;

drain lines independently provided for respective columns and connected to the drain electrodes of the pixels belonging to the respective columns;

gate lines independently provided for respective rows and connected to the gate electrodes of the pixels belonging to the respective rows; and counter lines connected to the counter electrodes;

wherein the counter lines include first counter lines at at least one of odd number columns and odd number rows being connected to the counter electrodes of the pixels belonging to at least one of the odd number columns and the odd number rows and second counter lines at at least one of even number columns and even number rows being connected to the counter electrodes of the pixels belonging to at least one of the even number columns and the even number rows, the first and second counter lines being independent of one another.

2. A liquid crystal panel according to claim 1, wherein the first counter lines are provided at the odd number columns and are connected to the counter electrodes of the pixels belonging to the odd number columns, and the second counter lines are provided at the even number columns and are connected to the counter electrodes of the pixels belonging to the even number columns.

3. A liquid crystal display device comprising:

a liquid crystal panel according to claim 2;

counter electrode drive means for forming counter electrode voltages and applying the counter electrode voltages on the counter lines;

gate drive means for successively selecting one of the gate lines and applying a select voltage on the selected gate line and a nonselect voltage on the unselected gate lines thereby applying the select voltage on the respective gate electrodes at every one frame period; and drain drive means for forming a positive drain voltage having a voltage level higher than the counter electrode voltages and a negative drain voltage having a voltage level lower than the counter electrode voltages with respect to one display data for alternately applying the positive drain voltage and the negative drain voltage on the drain lines at the every one frame period.

4. A liquid crystal display device according to claim 3, wherein the counter electrode drive means enables forming a high level counter electrode voltage and a low level counter electrode voltage having a voltage level lower than a voltage level of the high level counter electrode voltage as the counter electrode voltages, the counter electrode drive means applying alternately the high level counter electrode voltage and the low level counter electrode voltage of first phases on the first counter lines and applying alternately the low level counter electrode voltage and the high level counter electrode voltage of second phases which are reverse to the first phases on the second counter lines, and the drain drive means applying the negative drain voltage on the drain lines corresponding to the first and second counter lines on which the high level counter electrode voltage is applied and applying the positive drain voltage on the drain lines corresponding to the first and second counter lines on which the low level counter electrode voltage is applied.

5. A liquid crystal display device according to claim 4, wherein a difference between the positive drain voltage and the negative drain voltage is less than 5 V.

6. A liquid crystal display device according to claim 4, wherein when the entire liquid crystal panel is viewed with respect to a thickness direction of the liquid crystal panel a first region between the pixel electrodes and the counter electrodes is transparent and a second region other than the first region is opaque.

7. A liquid crystal display device according to claim 6, wherein at least one of the pixel electrodes and the counter electrodes is transparent.

8. A liquid crystal display device according to claim 7, wherein both of the pixel electrodes and counter electrodes are transparent.

9. A liquid crystal panel according to claim 1, wherein when the entire liquid crystal panel is viewed with respect to a thickness direction of the liquid crystal panel a first region between the pixel electrodes and the counter electrodes is transparent and a second region other than the first region is opaque.

10. A liquid crystal panel according to claim 9, wherein at least one of the pixel electrodes and the counter electrodes is transparent.

11. A liquid crystal panel according to claim 10, wherein both of the pixel electrodes and counter electrodes are transparent.

12. A liquid crystal panel according to claim 1, wherein the first counter lines are provided at the odd number rows and are connected to the counter electrodes of the pixels belonging to the odd number rows, and the second counter lines are provided at the even number rows and are connected to the counter electrodes of the pixels belonging to the even number rows.

13. A liquid crystal display device comprising:

a liquid crystal panel according to claim 12;

counter electrode drive means for forming counter electrode voltages and applying the counter electrode voltages on the counter lines;

gate drive means for successively selecting one of the gate lines and applying a select voltage on the selected gate line and a nonselect voltage on the unselected gate lines thereby applying the select voltage on the respective gate electrodes at every one frame period; and drain drive means for forming a positive drain voltage having a voltage level higher than the counter electrode voltages and a negative drain voltage having a voltage level lower than the counter electrode voltages with respect to one display data for alternately applying the positive drain voltage and the negative drain voltage at every other row.

14. A liquid crystal display device according to claim 13, wherein the counter electrode drive means enables forming a high level counter electrode voltage and a low level counter electrode voltage having a voltage level lower than a voltage level of the high level counter electrode voltage as the counter electrode voltages, the counter electrode drive means applying alternately the high level counter electrode voltage and the low level counter electrode voltage of first phases on the odd number row counter electrodes and applying the low level counter electrode voltage and the high level counter electrode voltage of second phases reverse to the first phases on the second counter lines, and wherein the drain drive means applies the negative drain voltage on the drain lines when the gate line corresponding to the first and second counter lines on which the high level counter electrode voltage is applied is selected and applies a positive drain voltage on the drain lines when the gate line corresponding to the first and second counter lines on which the low level counter electrode voltage is applied is selected.

15. A liquid crystal display device according to claim 14, wherein a difference between the positive drain voltage and the negative drain voltage is less than 5 V.

16. A liquid crystal display device according to claim 14, wherein when the entire liquid crystal panel is viewed with respect to a thickness direction of the liquid crystal panel a first region between the pixel electrodes and the counter electrodes is transparent and a second region other than the first region is opaque.

17. A liquid crystal display device according to claim 16, wherein at least one of the pixel electrodes and the counter electrodes are transparent.

18. A liquid crystal display device according to claim 17, wherein both of the pixel electrodes and counter electrodes are transparent.

19. A liquid crystal panel according to claim 1, wherein the first counter lines are connected to the counter electrodes of the pixels belonging to the odd number rows and the odd number columns and to the even number rows and the even number columns, and the second counter lines are connected to the counter electrodes of the pixels belonging to the even number rows and the odd number columns and to the odd number rows and the even number columns.

20. A liquid crystal display device comprising:

a liquid crystal panel according to claim 19;

counter electrode drive means for forming a counter electrode voltage and applying the counter electrode voltage on the counter lines;

gate drive means for successively selecting one of the gate lines of the liquid crystal panel and applying a select voltage on the selected gate line and a nonselect voltage on the unselected gate lines, thereby applying the select voltage on the respective gate electrodes at every one frame period; and drain drive means for forming a positive drain voltage having a voltage level higher than the counter electrode voltages and a negative drain voltage having a voltage level lower than the counter electrode voltages with respect to one display data for alternately applying the positive drain voltage and the negative drain voltage on the drain lines at every other row.

21. A liquid crystal display device according to claim 20, wherein the counter electrode drive means enables forming a high level counter electrode voltage and a low level counter electrode voltage having a voltage level lower than a voltage level of the high level counter electrode voltage as the counter electrode voltages, the counter electrode drive means applying alternately the high level counter electrode voltage and the low level counter electrode voltage of first phases on the first counter lines and applying the low level counter voltage and the high level counter electrode voltage of second phases which are reverse to the first phases on the second counter lines, and the drain drive means applying the negative drain voltage on the drain lines corresponding to the pixels when with respect to the respective pixels belonging to the selected row the high level counter electrode voltage is applied on the counter electrodes corresponding to the pixels and applying the positive drain voltage on the drain lines corresponding to the pixels when the low level counter electrode voltage is applied on the counter electrodes corresponding to the pixels.

22. A liquid crystal display device according to claim 21, wherein a difference between the positive drain voltage and the negative drain voltage is less than 5 V.

23. A liquid crystal display device according to claim 21, wherein when the entire liquid crystal panel is viewed with respect to a thickness direction of the liquid crystal panel a first region between the pixel electrodes and the counter electrodes is transparent and a second region other than the first region is opaque.

24. A liquid crystal display device according to claim 23, wherein at least one of the pixel electrodes and the counter electrodes is transparent.

25. A liquid crystal display device according to claim 24, wherein both of the pixel electrodes and counter electrodes are transparent.

26. A liquid crystal display device according to claim 1, wherein said pixel electrodes and said counter electrodes provided at the second substrate enable generation of the electric field having a component predominantly in parallel with one of the first and second substrates.

* * * * *